US008801205B2

(12) United States Patent
Harbers et al.

(10) Patent No.: US 8,801,205 B2
(45) **Date of Patent: *Aug. 12, 2014**

(54) LED ILLUMINATION DEVICE WITH COLOR CONVERTING SURFACES

(71) Applicant: Xicato, Inc., San Jose, CA (US)

(72) Inventors: Gerard Harbers, Sunnyvale, CA (US); Serge J. A. Bierhuizen, San Jose, CA (US); Hong Luo, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/902,631

(22) Filed: May 24, 2013

(65) Prior Publication Data

US 2013/0335946 A1 Dec. 19, 2013

Related U.S. Application Data

(63) Continuation of application No. 13/560,827, filed on Jul. 27, 2012, now Pat. No. 8,449,129.

(60) Provisional application No. 61/514,258, filed on Aug. 2, 2011.

(51) Int. Cl.
*F21V 9/16* (2006.01)

(52) U.S. Cl.
USPC ..... 362/84; 362/230; 362/240; 362/249.02; 362/260; 362/293; 313/501; 313/502

(58) Field of Classification Search
USPC ..... 362/84, 225, 217.08
See application file for complete search history.

(56) References Cited

U.S. PATENT DOCUMENTS

| | | | |
|---|---|---|---|
| 2,836,707 | A | 5/1958 | Stitt |
| 3,596,095 | A | 7/1971 | Leach |
| 5,959,316 | A | 9/1999 | Lowery |
| 6,068,383 | A | 5/2000 | Robertson et al. |
| 6,351,069 | B1 | 2/2002 | Lowery et al. |
| 6,504,301 | B1 | 1/2003 | Lowery |
| 6,586,882 | B1 | 7/2003 | Harbers |
| 6,600,175 | B1 | 7/2003 | Baretz et al. |

(Continued)

FOREIGN PATENT DOCUMENTS

| | | | |
|---|---|---|---|
| DE | 100 44 455 | A1 | 4/2002 |
| GB | 2 365 962 | A | 2/2002 |

(Continued)

OTHER PUBLICATIONS

U.S. Appl. No. 13/560,827, filed Jul. 27, 2012 by Xicato, Inc., 51 pages.

(Continued)

*Primary Examiner* — Ismael Negron
(74) *Attorney, Agent, or Firm* — Silicon Valley Patent Group LLP

(57) ABSTRACT

An illumination module includes a color conversion cavity with a first interior surface having a first wavelength converting material and a second interior surface having a second wavelength converting material. A first LED is configured to receive a first current and to emit light that preferentially illuminates the first interior surface. A second LED is configured to receive a second current and emit light that preferentially illuminates the second interior surface. The first current and the second current are selectable to achieve a range of correlated color temperature (CCT) of light output by the LED based illumination device.

14 Claims, 15 Drawing Sheets

(56) References Cited

U.S. PATENT DOCUMENTS

| | | | |
|---|---|---|---|
| 6,680,569 | B2 | 1/2004 | Mueller-Mach et al. |
| 6,682,207 | B2 | 1/2004 | Weber et al. |
| 6,812,500 | B2 | 11/2004 | Reeh et al. |
| 7,126,162 | B2 | 10/2006 | Reeh et al. |
| 7,250,715 | B2 | 7/2007 | Mueller et al. |
| 7,479,662 | B2 | 1/2009 | Soules et al. |
| 7,564,180 | B2 | 7/2009 | Brandes |
| 7,572,029 | B2 | 8/2009 | Tsai |
| 7,614,759 | B2 | 11/2009 | Negley |
| 7,629,621 | B2 | 12/2009 | Reeh et al. |
| 7,819,539 | B2 | 10/2010 | Kim et al. |
| 7,902,560 | B2 | 3/2011 | Bierhuizen et al. |
| 7,942,540 | B2 | 5/2011 | Harbers et al. |
| 8,021,008 | B2 | 9/2011 | Ramer |
| 8,217,567 | B2 | 7/2012 | Van De Ven et al. |
| 8,403,529 | B2 | 3/2013 | Harbers |
| 8,449,129 | B2 | 5/2013 | Harbers et al. |
| 2004/0207998 | A1 | 10/2004 | Suehiro et al. |
| 2006/0152140 | A1 | 7/2006 | Brandes |
| 2007/0081336 | A1 | 4/2007 | Bierhuizen et al. |
| 2008/0142816 | A1 | 6/2008 | Bierhuizen et al. |
| 2008/0310158 | A1 | 12/2008 | Harbers et al. |
| 2009/0103293 | A1 | 4/2009 | Harbers et al. |
| 2009/0103296 | A1 | 4/2009 | Harbers et al. |
| 2010/0254115 | A1 | 10/2010 | Wegh et al. |
| 2010/0321919 | A1 | 12/2010 | Yang |
| 2012/0007492 | A1 | 1/2012 | Hussell et al. |
| 2012/0081880 | A1 | 4/2012 | Narendran et al. |
| 2012/0147588 | A1 | 6/2012 | Yang |
| 2012/0287624 | A1 | 11/2012 | Harbers |
| 2012/0300452 | A1 | 11/2012 | Harbers et al. |

FOREIGN PATENT DOCUMENTS

| | | | |
|---|---|---|---|
| WO | WO 2008/072196 | A1 | 6/2008 |
| WO | WO 2008/149250 | A1 | 12/2008 |
| WO | WO 2009/107052 | A1 | 9/2009 |

OTHER PUBLICATIONS

Office Action mailed on Dec. 10, 2012 for U.S. Appl. No. 13/560,827, filed Jul. 27, 2012 by Xicato et al., 17 pages.

Response to Office Action mailed on Mar. 8, 2013 for U.S. Appl. No. 13/560,827, filed Jul. 27, 2012 by Xicato et al., 121 pages.

Notice of Allowance mailed on Mar. 22, 2013 for U.S. Appl. No. 13/560,827, filed Jul. 27, 2012 by Xicato et al., 10 pages.

Corrected Notice of Allowance mailed on Apr. 29, 2013 for U.S. Appl. No. 13/560,827, filed Jul. 27, 2012 by Xicato et al., 4 pages.

Invitation to Pay Additional Fees and Partial International Search mailed on Feb. 12, 2013 for PCT/US/2012/048867 filed on Jul. 30, 2012 by Xicato, Inc., 7 pages.

International Search Report and Written Opinion mailed on May 27, 2013 for PCT/US/2012/048867 filed on Jul. 30, 2012 by Xicato, Inc., 19 pages.

Machine Translation in English of Abstract of DE 100 44 455 A1 at <www.espacenet.com> visited on Feb. 28, 2013, 1 page.

U.S. Appl. No. 13/560,830, filed Jul. 27, 2012 by Xicato, Inc., 59 pages.

Notice of Allowance mailed on Sep. 28, 2012 for U.S. Appl. No. 13/560,830, filed Jul. 27, 2012 by Xicato, Inc., 9 pages.

Request for Continued Examination mailed on Oct. 19, 2012 for U.S. Appl. No. 13/560,830, filed Jul. 27, 2012 by Xicato, Inc., 6 pages.

Notice of Allowance mailed on Nov. 13, 2012 for U.S. Appl. No. 13/560,830, filed Jul. 27, 2012 by Xicato, Inc., 7 pages.

Amendment After Notice of Allowance mailed on Feb. 13, 2013 for U.S. Appl. No. 13/560,830, filed Jul. 27, 2012 by Xicato, Inc., 10 pages.

Amendment After Notice of Allowance mailed on Feb. 16, 2013 for U.S. Appl. No. 13/560,830, filed Jul. 27, 2012 by Xicato, Inc., 1 page.

U.S. Appl. No. 13/849,419, filed Mar. 22, 2013 by Xicato, Inc., 45 pages.

International Search Report and Written Opinion mailed on Jul. 29, 2013 for PCT/US/2012/048869 filed on Jul. 30, 2012 by Xicato, Inc., 8 pages.

Office Action mailed on Sep. 17, 2013 for U.S. Appl. No. 13/849,419, filed Mar. 22, 2013, 19 pages.

Notice of Allowance mailed on Feb. 26, 2014 for U.S. Appl. No. 13/849,419, filed Mar. 22, 2013, 11 pages.

LED ILLUMINATION DEVICE WITH COLOR CONVERTING SURFACES

CROSS REFERENCE TO RELATED APPLICATIONS

This application is a continuation of U.S. application Ser. No. 13/560,827, filed Jul. 27, 2012, which, in turn, claims priority under 35 USC 119 to U.S. Provisional Application No. 61/514,258, filed Aug. 2, 2011, both of which are incorporated by reference herein in their entireties.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

Consequently, improvements to illumination device that uses light emitting diodes as the light source are desired.

SUMMARY

An illumination module includes a color conversion cavity with a first interior surface having a first wavelength converting material and a second interior surface having a second wavelength converting material. A first LED is configured to receive a first current and to emit light that preferentially illuminates the first interior surface. A second LED is configured to receive a second current and emit light that preferentially illuminates the second interior surface. The first current and the second current are selectable to achieve a range of correlated color temperature (CCT) of light output by the LED based illumination device.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1:
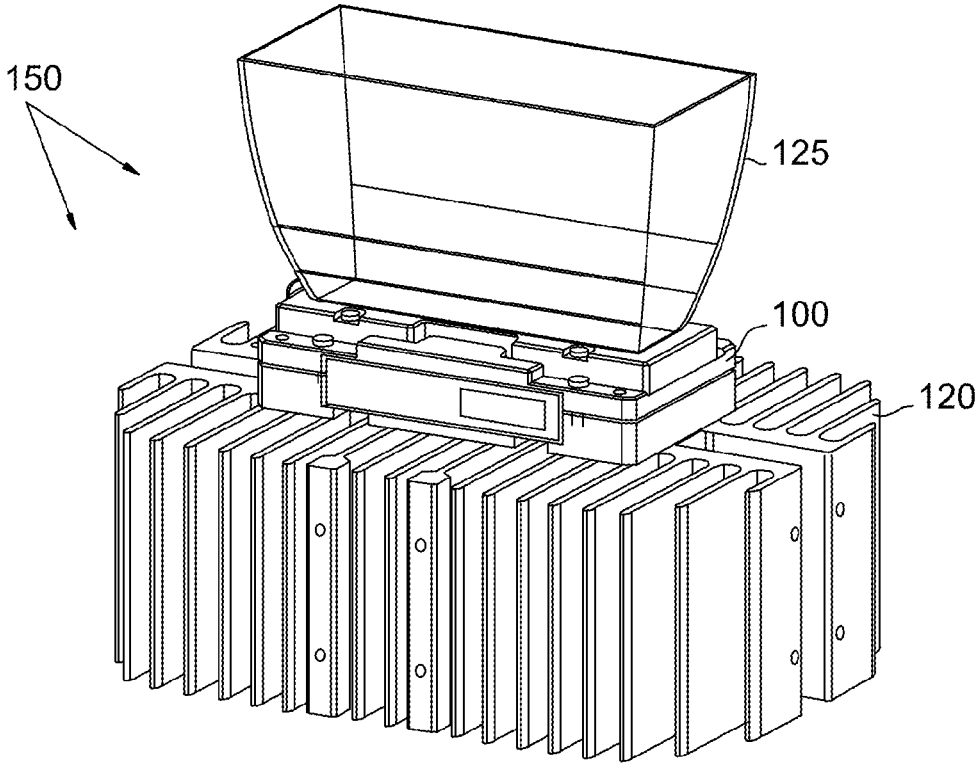
FIGS. 1, 2, and 3 illustrate three exemplary luminaires, including an illumination device, reflector, and light fixture.
Figure 2:
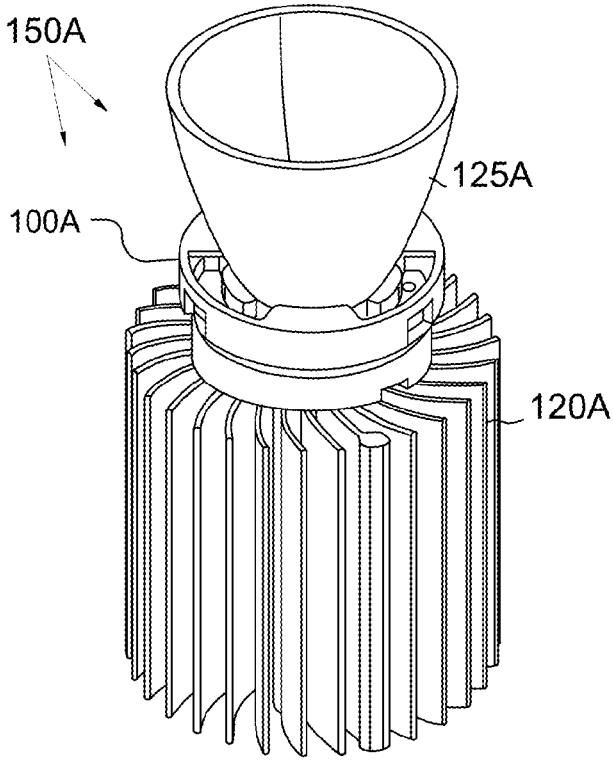
Figure 3:
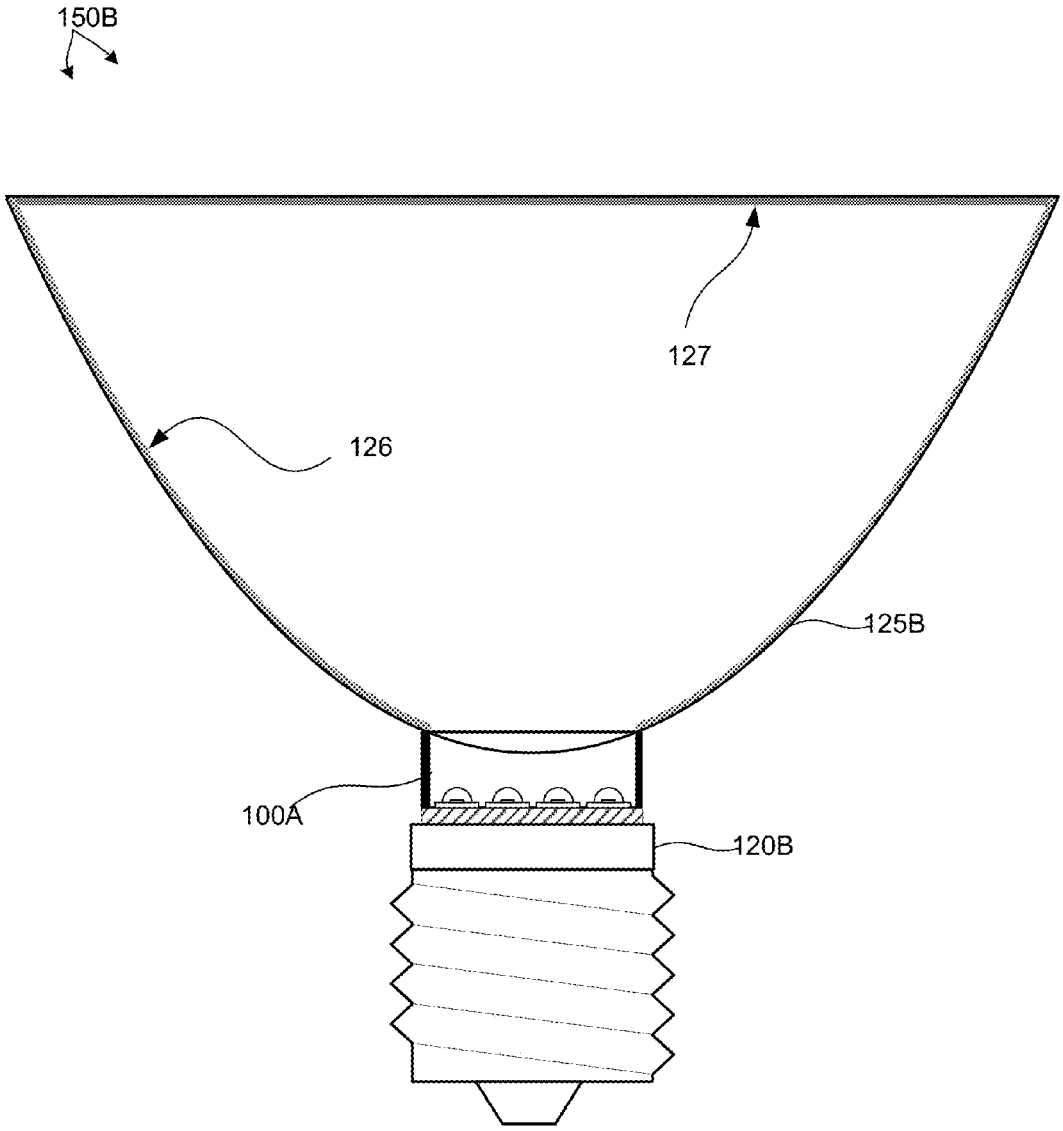

FIGS. 1, 2, and 3 illustrate three exemplary luminaires, all labeled 150. The luminaire illustrated in FIG. 1 includes an illumination module 100 with a rectangular form factor. The luminaire illustrated in FIG. 2 includes an illumination module 100A with a circular form factor. The luminaire illustrated in FIG. 3 includes an illumination module 100A integrated into a retrofit lamp device. These examples are for illustrative purposes. Examples of illumination modules of general polygonal and elliptical shapes may also be contemplated. Luminaire 150 includes illumination module 100, reflector 125, and light fixture 120. As depicted, light fixture 120 includes a heat sink capability, and therefore may be sometimes referred to as heat sink 120. However, light fixture 120 may include other structural and decorative elements (not shown). Reflector 125 is mounted to illumination module 100 to collimate or deflect light emitted from illumination module 100. The reflector 125 may be made from a thermally conductive material, such as a material that includes aluminum or copper and may be thermally coupled to illumination module 100. Heat flows by conduction through illumination module 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be removably coupled to illumination module 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination module 100 is mounted to heat sink 120. Heat sink 120 may be made from a thermally conductive material, such as a material that includes aluminum or copper and may be thermally coupled to illumination module 100. Heat flows by conduction through illumination module 100 and the thermally conductive heat sink 120. Heat also flows via thermal convection over heat sink 120. Illumination module 100 may be attached to heat sink 120 by way of screw threads to clamp the illumination module 100 to the heat sink 120. To facilitate easy removal and replacement of illumination module 100, illumination module 100 may be removably coupled to heat sink 120, e.g., by means of a clamp mechanism, a twist-lock mechanism, or other appropriate arrangement. Illumination module 100 includes at least one thermally conductive surface that is thermally coupled to heat sink 120, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 120 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
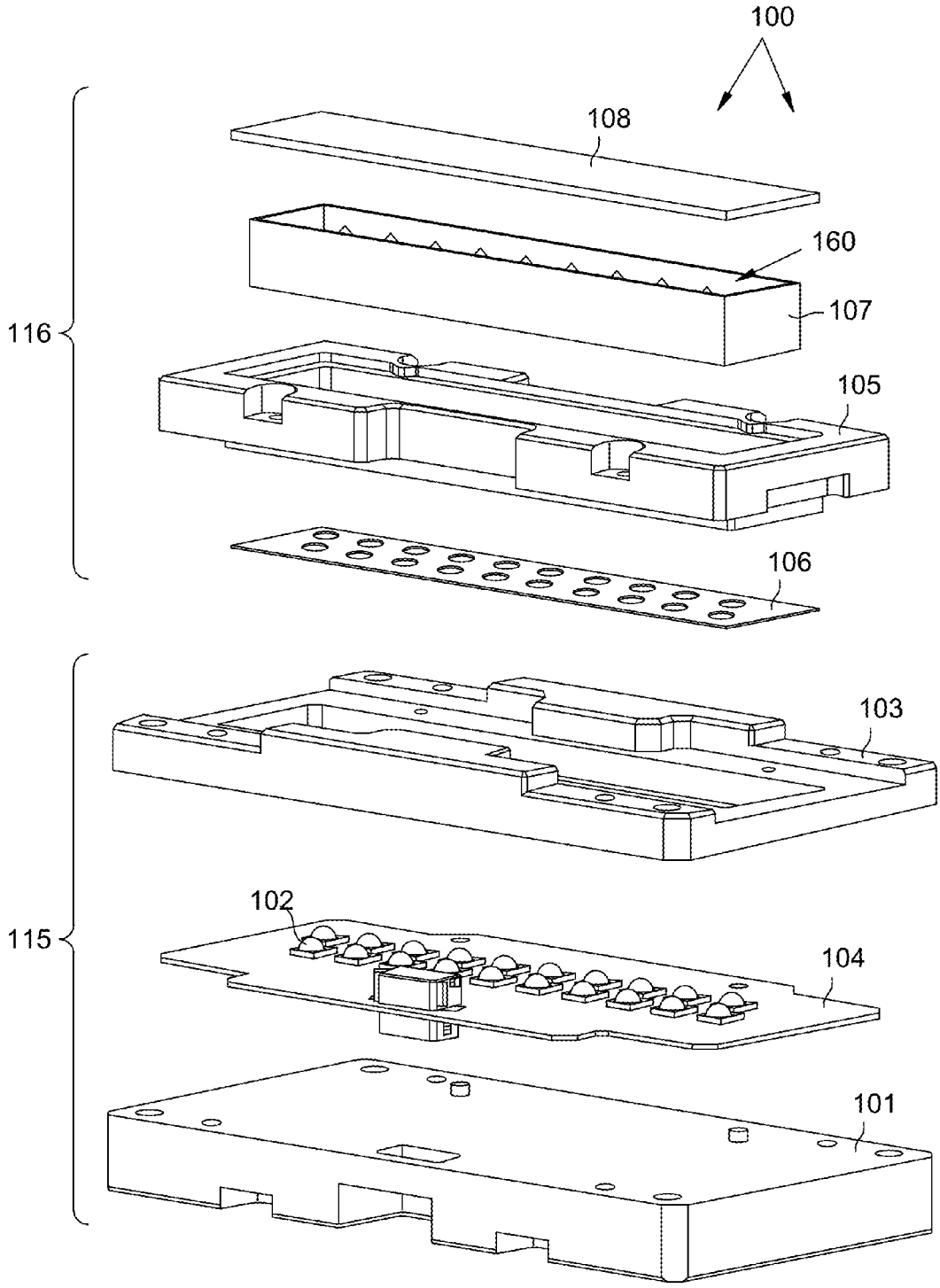
FIG. 4 illustrates an exploded view of components of the LED based illumination module depicted in FIG. 1.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 may include a bottom reflector 106 and sidewall 107, which may optionally be formed from inserts. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a polytetrafluoroethylene PTFE material. In some examples inserts 106 and 107 may be made from a PTFE material of one to two millimeters thick, as sold by W.L. Gore (USA) and Berghof (Germany). In yet other embodiments, inserts 106 and 107 may be constructed from a PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide (TiO2), zinc oxide (ZnO), and barium sulfate (BaSO4) particles, or a combination of these materials.

Figure 5A:
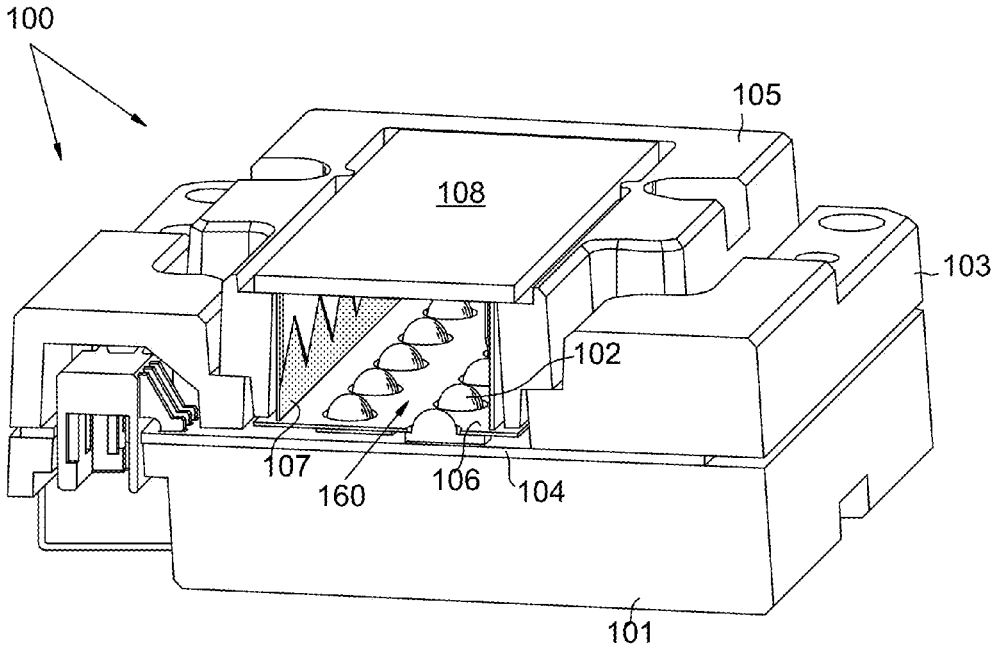
FIGS. 5A and 5B illustrate perspective, cross-sectional views of the LED based illumination module depicted in FIG. 1.
Figure 5B:
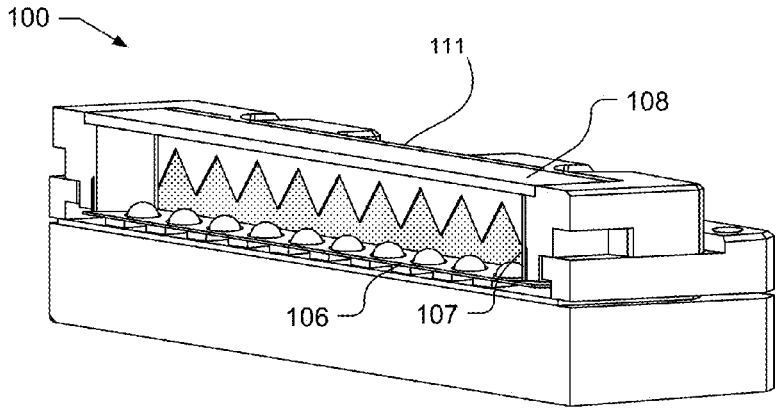

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a color conversion cavity 160 (illustrated in FIG. 5A) in the LED based illumination module 100. A portion of light from the LEDs 102 is reflected within color conversion cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

As depicted in FIGS. 1-5B, light generated by LEDs 102 is generally emitted into color conversion cavity 160. However, various embodiments are introduced herein to preferentially direct light emitted from specific LEDs 102 to specific interior surfaces of LED based illumination module 100. In this manner, LED based illumination module 100 includes preferentially stimulated color converting surfaces. In one aspect, light emitted by certain LEDs 102 is preferentially directed to an interior surface of color conversion cavity 160 that includes a first wavelength converting material and light emitted from certain other LEDs 102 is preferentially directed to another interior surface of color conversion cavity 160 that includes a second wavelength converting material. In this manner effective color conversion may be achieved more efficiently than by generally flooding the interior surfaces of color conversion cavity 160 with light emitted from LEDs 102.

LEDs 102 can emit different or the same colors, either by direct emission or by phosphor conversion, e.g., where phosphor layers are applied to the LEDs as part of the LED package. The illumination module 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination module 100 may use any combination of polarized or non-polarized LEDs. In some embodiments, LEDs 102 emit either blue or UV light because of the efficiency of LEDs emitting in these wavelength ranges. The light emitted from the illumination module 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical and/or physical (such as thickness and concentration) properties of the wavelength converting materials and the geometric properties of the coatings on the interior surfaces of cavity 160, specific color properties of light output by output window 108 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: Y3Al5O12:Ce, (also known as YAG:Ce, or simply YAG) (Y,Gd)3Al5O12:Ce, CaS:Eu, SrS:Eu, SrGa2S4:Eu, Ca3(Sc,Mg)2Si3O12:Ce, Ca3Sc2Si3O12:Ce, Ca3Sc2O4:Ce, Ba3Si6O12N2:Eu, (Sr, Ca)AlSiN3:Eu, CaAlSiN3:Eu, CaAlSi(ON)3:Eu, Ba2SiO4:Eu, Sr2SiO4:Eu, Ca2SiO4:Eu, CaSc2O4:Ce, CaSi2O2N2:Eu, SrSi2O2N2:Eu, BaSi2O2N2:Eu, Ca5(PO4)3Cl:Eu, Ba5(PO4)3Cl:Eu, Cs2CaP2O7, Cs2SrP2O7, Lu3Al5O12:Ce, Ca8Mg(SiO4)4Cl2:Eu, Sr8Mg(SiO4)4Cl2:Eu, La3Si6N11:Ce, Y3Ga5O12:Ce, Gd3Ga5O12:Ce, Tb3Al5O12:Ce, Tb3Ga5O12:Ce, and Lu3Ga5O12:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g., (Sr,Ca)AlSiN3:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of light mixing cavity 160, the color point of the light emitted from the module can be tuned as desired.

In one example, a single type of wavelength converting material may be patterned on the sidewall, which may be, e.g., the sidewall insert 107 shown in FIG. 5B. By way of example, a red phosphor may be patterned on different areas of the sidewall insert 107 and a yellow phosphor may cover the output window 108. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature.

In many applications it is desirable to generate white light output with a correlated color temperature (CCT) less than 3,100 Kelvin. For example, in many applications, white light with a CCT of 2,700 Kelvin is desired. Some amount of red emission is generally required to convert light generated from LEDs emitting in the blue or UV portions of the spectrum to a white light output with a CCT less than 3,100 Kelvin. Efforts are being made to blend yellow phosphor with red emitting phosphors such as CaS:Eu, SrS:Eu, SrGa2S4:Eu, Ba3Si6O12N2:Eu, (Sr,Ca)AlSiN3:Eu, CaAlSiN3:Eu, CaAlSi(ON)3:Eu, Ba2SiO4:Eu, Sr2SiO4:Eu, Ca2SiO4:Eu, CaSi2O2N2:Eu, SrSi2O2N2:Eu, BaSi2O2N2:Eu, Sr8Mg(SiO4)4Cl2:Eu, Li2NbF7:Mn4+, Li3ScF6:Mn4+, La2O2S:Eu3+ and MgO.MgF2.GeO2:Mn4+ to reach required CCT. However, color consistency of the output light is typically poor due to the sensitivity of the CCT of the output light to the red phosphor component in the blend. Poor color distribution is more noticeable in the case of blended phosphors, particularly in lighting applications. By coating output window 108 with a phosphor or phosphor blend that does not include any red emitting phosphor, problems with color consistency may be avoided. To generate white light output with a CCT less than 3,100 Kelvin, a red emitting phosphor or phosphor blend is deposited on any of the sidewalls and bottom reflector of LED based illumination module 100. The specific red emitting phosphor or phosphor blend (e.g. peak wavelength emission from 600 nanometers to 700 nanometers) as well as the concentration of the red emitting phosphor or phosphor blend are selected to generate a white light output with a CCT less than 3,100 Kelvin. In this manner, an LED based illumination module may generate white light with a CCT less than 3,100K with an output window that does not include a red emitting phosphor component.

It is desirable for an LED based illumination module, to convert a portion of light emitted from the LEDs (e.g. blue light emitted from LEDs 102) to longer wavelength light in at least one color conversion cavity 160 while minimizing photon loses. Densely packed, thin layers of phosphor are suitable to efficiently color convert a significant portion of incident light while minimizing loses associated with reabsorption by adjacent phosphor particles, total internal reflection (TIR), and Fresnel effects.

Figure 6:
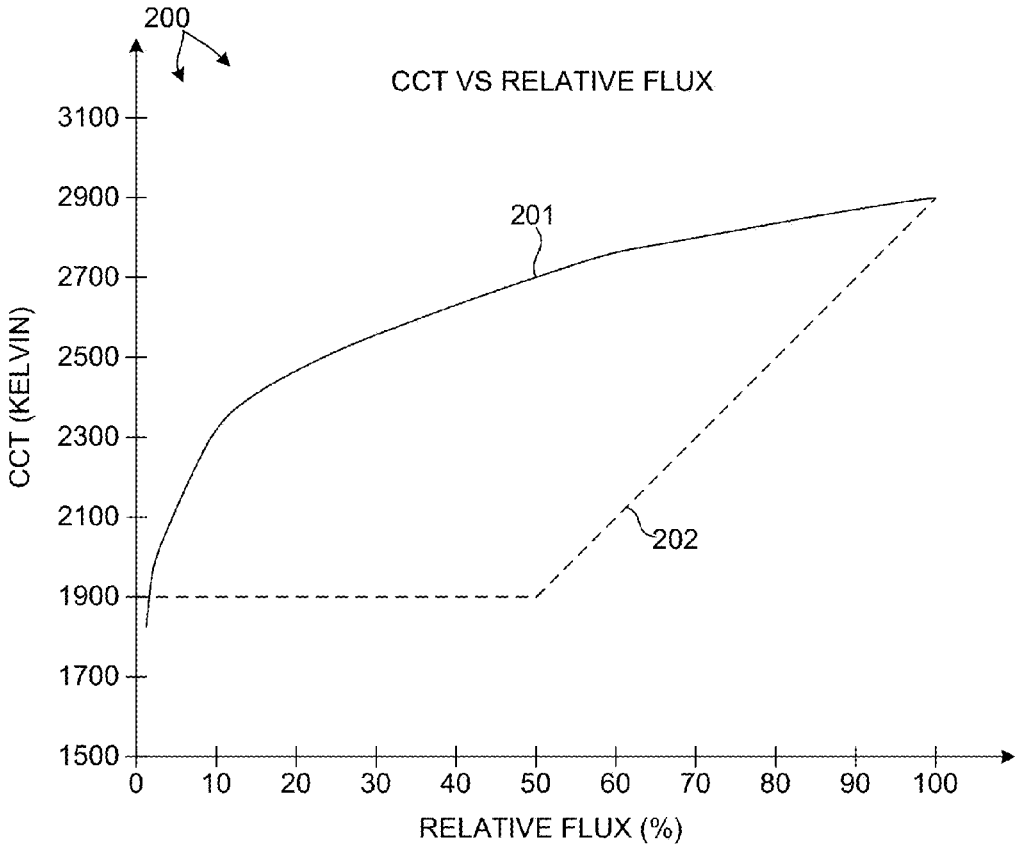
FIG. 6 illustrates a plot of correlated color temperature (CCT) versus relative flux for a halogen light source and a LED based illumination device in one embodiment.

FIG. 6 illustrates a plot 200 of correlated color temperature (CCT) versus relative flux for a halogen light source. Relative flux is plotted as a percentage of the maximum rated power level of the device. For example, 100% is operation of the light source at it maximum rated power level, and 50% is operation of the light source at half its maximum rated power level. Plotline 201 is based on experimental data collected from a 35 W halogen lamp. As illustrated, at the maximum rated power level, the 35 W halogen lamp light emission was 2900K. As the halogen lamp is dimmed to lower relative flux levels, the CCT of light output from the halogen lamp is reduced. For example, at 25% relative flux, the CCT of the light emitted from the halogen lamp is approximately 2500K. To achieve further reductions in CCT, the halogen lamp must be dimmed to very low relative flux levels. For example, to achieve a CCT less than 2100K, the halogen lamp must be driven to a relative flux level of less than 5%. Although, a traditional halogen lamp is capable of achieving CCT levels below 2100K, it is able to do so only by severely reducing the intensity of light emitted from each lamp. These extremely low intensity levels leave dining spaces very dark and uncomfortable for patrons.

A more desirable option is a light source that exhibits a dimming characteristic similar to the illustration of line 202. Line 202 exhibits a reduction in CCT as light intensity is reduced to from 100% to 50% relative flux. At 50% relative flux, a CCT of 1900K is obtained. Further reductions, in relative flux do not change the CCT significantly. In this manner, a restaurant operator may adjust the intensity of the light level in the environment over a broad range (e.g., 0-50% relative flux) to a desired level without changing the desirable CCT characteristics of the emitted light. Line 202 is illustrated by way of example. Many other exemplary color characteristics for dimmable light sources may be contemplated.

In some embodiments, LED based illumination device 100 may be configured to achieve relatively large changes in CCT with relatively small changes in flux levels (e.g., as illustrated in line 202 from 50-100% relative flux) and also achieve relatively large changes in flux level with relatively small changes in CCT (e.g., as illustrated in line 202 from 0-50% relative flux).

Figure 7:
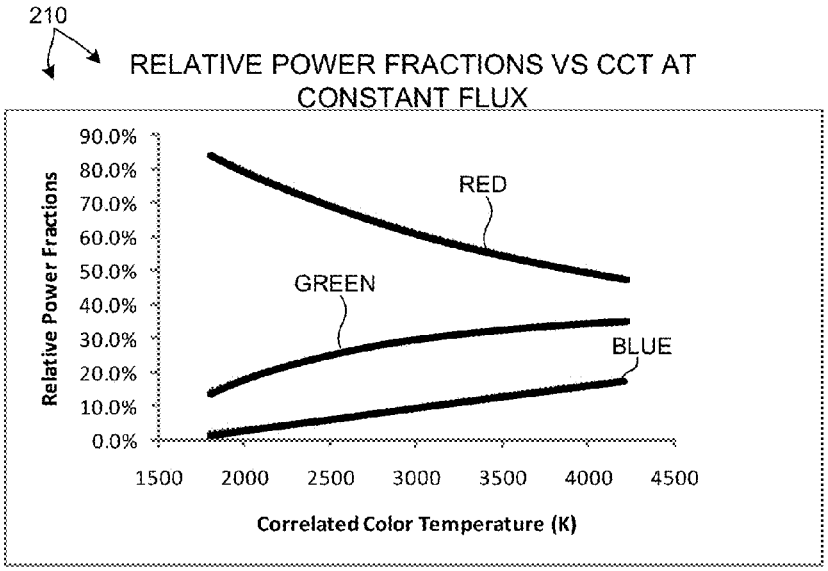
FIG. 7 illustrates a plot of simulated relative power fractions necessary to achieve a range of CCTs for light emitted from an LED based illumination module.

FIG. 7 illustrates a plot 210 of simulated relative power fractions necessary to achieve a range of CCTs for light emitted from an LED based illumination module 100. The relative power fractions describe the relative contribution of three different light emitting elements within LED based illumination module 100: an array of blue emitting LEDs, an amount of green emitting phosphor (model BG201A manufactured by Mitsubishi, Japan), and an amount of red emitting phosphor (model BR102D manufactured by Mitsubishi, Japan). As illustrated in FIG. 7, contributions from a red emitting element must dominate over both green and blue emission to achieve a CCT level below 2100K. In addition, blue emission must be significantly attenuated.

Figure 8:
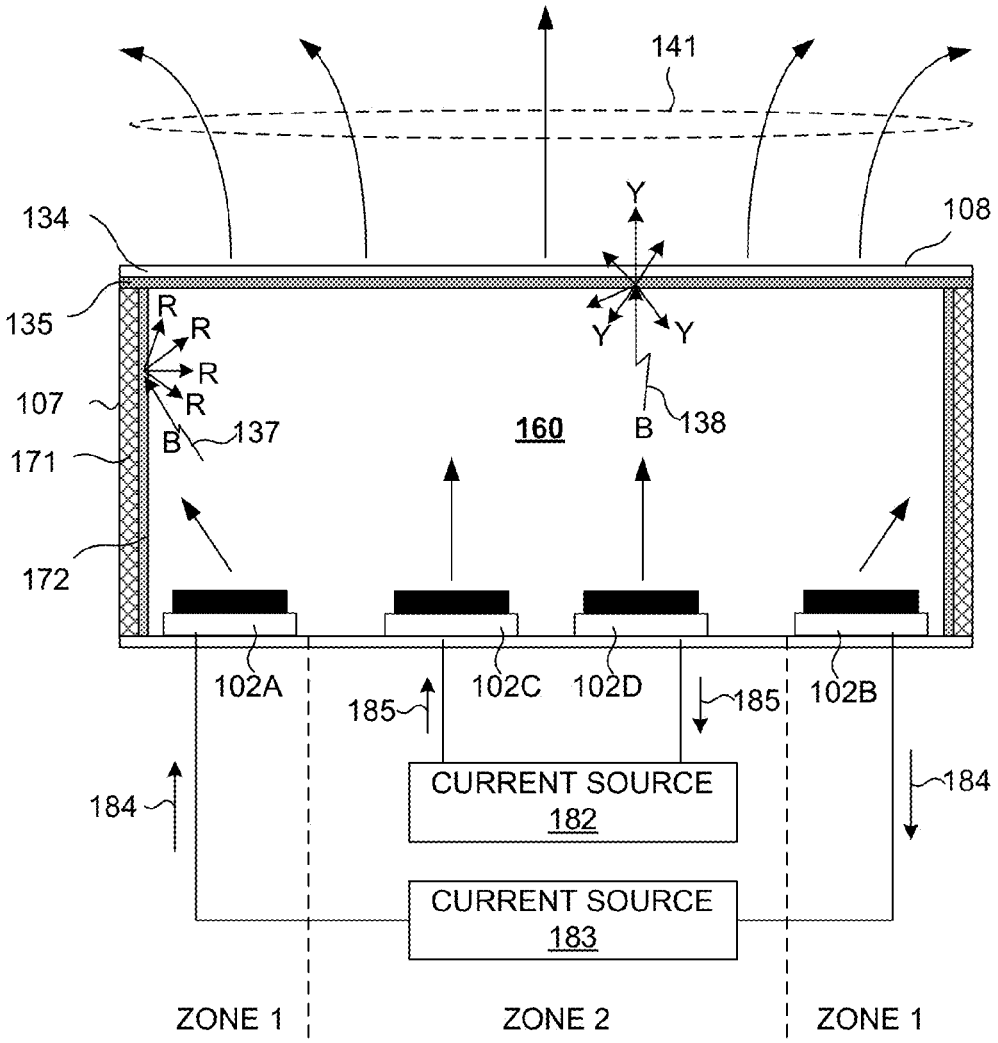
FIG. 8 is illustrative of a cross-sectional, side view of an LED based illumination module in one embodiment.

Changes in CCT over the full operational range of an LED based illumination device 100 may be achieved by employing LEDs with similar emission characteristics (e.g., all blue emitting LEDs) that preferentially illuminate different color converting surfaces. By controlling the relative flux emitted from different zones of LEDs (by independently controlling current supplied to LEDs in different zones as illustrated in FIG. 8), changes in CCT may be achieved. For example, changes of more than 300 Kelvin, over the full operational range may be achieved in this manner.

Changes in CCT over the operational range of an LED based illumination device 100 may also be achieved by introducing different LEDs that preferentially illuminate different color converting surfaces. By controlling the relative flux emitted from different zones of LEDs of different types (by independently controlling current supplied to LEDs in different zones as illustrated in FIG. 8), changes in CCT may be achieved. For example, changes of more than 500K may be achieved in this manner.

FIG. 8 is illustrative of a cross-sectional, side view of an LED based illumination module in one embodiment. As illustrated, LED based illumination module includes a plurality of LEDs 102A-102D, a sidewall 107 and an output window 108. Sidewall 107 includes a reflective layer 171 and a color converting layer 172. Color converting layer 172 includes a wavelength converting material (e.g., a red-emitting phosphor material). Output window 108 includes a transmissive layer 134 and a color converting layer 135. Color converting layer 135 includes a wavelength converting material with a different color conversion property than the wavelength converting material included in sidewall 107 (e.g., a yellow-emitting phosphor material). Color conversion cavity 160 is formed by the interior surfaces of the LED based illumination module including the interior surface of sidewall 107 and the interior surface of output window 108.

The LEDs 102A-102D of LED based illumination module emit light directly into color conversion cavity 160. Light is mixed and color converted within color conversion cavity 160 and the resulting combined light 141 is emitted by LED based illumination module.

A different current source supplies current to LEDs 102 in different preferential zones. In the example depicted in FIG. 8, current source 182 supplies current 185 to LEDs 102C and 102D located in preferential zone 2. Similarly, current source 183 supplies current 184 to LEDs 102A and 102B located in preferential zone 1. By separately controlling the current supplied to LEDs located in different preferential zones, the correlated color temperatures (CCT) of combined light 141 output by LED based illumination module may be adjusted over a broad range of CCTs. For example, the range of achievable CCTs may exceed 300 Kelvin. In other examples, the range of achievable CCTs may exceed 500 Kelvin. In yet another example, the range of achievable CCTs may exceed 1,000 Kelvin. In some examples, the achievable CCT may be less than 2,000 Kelvin.

In one aspect, LEDs 102 included in LED based illumination module are located in different zones that preferentially illuminate different color converting surfaces of color conversion cavity 160. For example, as illustrated, some LEDs 102A and 102B are located in zone 1. Light emitted from LEDs 102A and 102B located in zone 1 preferentially illuminates sidewall 107 because LEDs 102A and 102B are positioned in close proximity to sidewall 107. In some embodiments, more than fifty percent of the light output by LEDs 102A and 102B is directed to sidewall 107. In some other embodiments, more than seventy five percent of the light output by LEDs 102A and 102B is directed to sidewall 107. In some other embodiments, more than ninety percent of the light output by LEDs 102A and 102B is directed to sidewall 107.

As illustrated, some LEDs 102C and 102D are located in zone 2. Light emitted from LEDs 102C and 102D in zone 2 is directed toward output window 108. In some embodiments, more than fifty percent of the light output by LEDs 102C and 102D is directed to output window 108. In some other embodiments, more than seventy five percent of the light output by LEDs 102C and 102D is directed to output window 108. In some other embodiments, more than ninety percent of the light output by LEDs 102C and 102D is directed to output window 108.

In one embodiment, light emitted from LEDs located in preferential zone 1 is directed to sidewall 107 that may include a red-emitting phosphor material, whereas light emitted from LEDs located in preferential zone 2 is directed to output window 108 that may include a green-emitting phosphor material and a red-emitting phosphor material. By adjusting the current 184 supplied to LEDs located in zone 1 relative to the current 185 supplied to LEDs located in zone 2, the amount of red light relative to green light included in combined light 141 may be adjusted. In addition, the amount of blue light relative to red light is also reduced because the a larger amount of the blue light emitted from LEDs 102 interacts with the red phosphor material of color converting layer 172 before interacting with the green and red phosphor materials of color converting layer 135. In this manner, the probability that a blue photon emitted by LEDs 102 is converted to a red photon is increased as current 184 is increased relative to current 185. Thus, control of currents 184 and 185 may be used to tune the CCT of light emitted from LED based illumination module from a relatively high CCT (e.g., approximately 3,000 Kelvin) to a relatively low CCT (e.g., approximately 2,000 Kelvin) in accordance with the proportions indicated in FIG. 7.

In some embodiments, LEDs 102A and 102B in zone 1 may be selected with emission properties that interact efficiently with the wavelength converting material included in sidewall 107. For example, the emission spectrum of LEDs 102A and 102B in zone 1 and the wavelength converting material in sidewall 107 may be selected such that the emission spectrum of the LEDs and the absorption spectrum of the wavelength converting material are closely matched. This ensures highly efficient color conversion (e.g., conversion to red light). Similarly, LEDs 102C and 102D in zone 2 may be selected with emission properties that interact efficiently with the wavelength converting material included in output window 108. For example, the emission spectrum of LEDs 102C and 102D in zone 2 and the wavelength converting material in output window 108 may be selected such that the emission spectrum of the LEDs and the absorption spectrum of the wavelength converting material are closely matched. This ensures highly efficient color conversion (e.g., conversion to red and green light).

Furthermore, employing different zones of LEDs that each preferentially illuminates a different color converting surface minimizes the occurrence of an inefficient, two-step color conversion process. By way of example, a photon 138 generated by an LED (e.g., blue, violet, ultraviolet, etc.) from zone 2 is directed to color converting layer 135. Photon 138 interacts with a wavelength converting material in color converting layer 135 and is converted to a Lambertian emission of color converted light (e.g., green light). By minimizing the content of red-emitting phosphor in color converting layer 135, the probability is increased that the back reflected red and green light will be reflected once again toward the output window 108 without absorption by another wavelength converting material. Similarly, a photon 137 generated by an LED (e.g., blue, violet, ultraviolet, etc.) from zone 1 is directed to color converting layer 172. Photon 137 interacts with a wavelength converting material in color converting layer 172 and is converted to a Lambertian emission of color converted light (e.g., red light). By minimizing the content of green-emitting phosphor in color converting layer 172, the probability is increased that the back reflected red light will be reflected once again toward the output window 108 without reabsorption.

In another embodiment, LEDs 102 positioned in zone 2 of FIG. 8 are ultraviolet emitting LEDs, while LEDs 102 positioned in zone 1 of FIG. 8 are blue emitting LEDs. Color converting layer 172 includes any of a yellow-emitting phosphor and a green-emitting phosphor. Color converting layer 135 includes a red-emitting phosphor. The yellow and/or green emitting phosphors included in sidewall 107 are selected to have narrowband absorption spectra centered near the emission spectrum of the blue LEDs of zone 1, but far away from the emission spectrum of the ultraviolet LEDs of zone 2. In this manner, light emitted from LEDs in zone 2 is preferentially directed to output window 108, and undergoes conversion to red light. In addition, any amount of light emitted from the ultraviolet LEDs that illuminates sidewall 107 results in very little color conversion because of the insensitivity of these phosphors to ultraviolet light. In this manner, the contribution of light emitted from LEDs in zone 2 to combined light 141 is almost entirely red light. In this manner, the amount of red light contribution to combined light 141 can be influenced by current supplied to LEDs in zone 2. Light emitted from blue LEDs positioned in zone 1 is preferentially directed to sidewall 107 and results in conversion to green and/or yellow light. In this manner, the contribution of light emitted from LEDs in zone 1 to combined light 141 is a combination of blue and yellow and/or green light. Thus, the amount of blue and yellow and/or green light contribution to combined light 141 can be influenced by current supplied to LEDs in zone 1.

To emulate the desired dimming characteristics illustrated by line 202 of FIG. 6, LEDs in zones 1 and 2 may be independently controlled. For example, at 2900K, the LEDs in zone 1 may operate at maximum current levels with no current supplied to LEDs in zone 2. To reduce the color temperature, the current supplied to LEDs in zone 1 may be reduced while the current supplied to LEDs in zone 2 may be increased. Since the number of LEDs in zone 2 is less than the number in zone 1, the total relative flux of LED based illumination module is reduced. Because LEDs in zone 2 contribute red light to combined light 141, the relative contribution of red light to combined light 141 increases. As indicated in FIG. 7, this is necessary to achieve the desired reduction in CCT. At 1900K, the current supplied to LEDs in zone 1 is reduced to a very low level or zero and the dominant contribution to combined light comes from LEDs in zone 2. To further reduce the output flux of LED based illumination module, the current supplied to LEDs in zone 2 is reduced with little or no change to the current supplied to LEDs in zone 1. In this operating region, combined light 141 is dominated by light supplied by LEDs in zone 2. For this reason, as the current supplied to LEDs in zone 2 is reduced, the color temperature remains roughly constant (1900K in this example).

Figure 9:
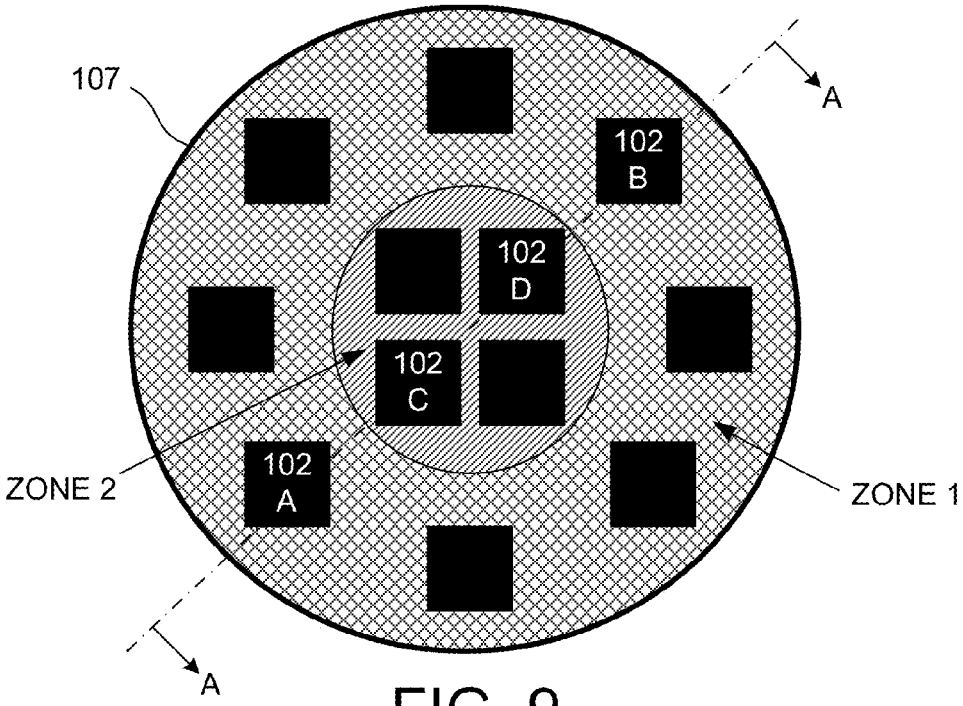
FIG. 9 is illustrative of a top view of the LED based illumination module depicted in FIG. 8.

FIG. 9 is illustrative of a top view of LED based illumination module depicted in FIG. 8. Section A depicted in FIG. 9 is the cross-sectional view depicted in FIG. 8. As depicted, in this embodiment, LED based illumination module is circular in shape as illustrated in the exemplary configurations depicted in FIG. 2 and FIG. 3. In this embodiment, LED based illumination module is divided into annular zones (e.g., zone 1 and zone 2) that include different groups of LEDs 102. As illustrated, zones 1 and zones 2 are separated and defined by their relative proximity to sidewall 107. Although, LED based illumination module, as depicted in FIGS. 8 and 9, is circular in shape, other shapes may be contemplated. For example, LED based illumination module may be polygonal in shape. In other embodiments, LED based illumination module may be any other closed shape (e.g., elliptical, etc.). Similarly, other shapes may be contemplated for any zones of LED based illumination module.

Figure 10:
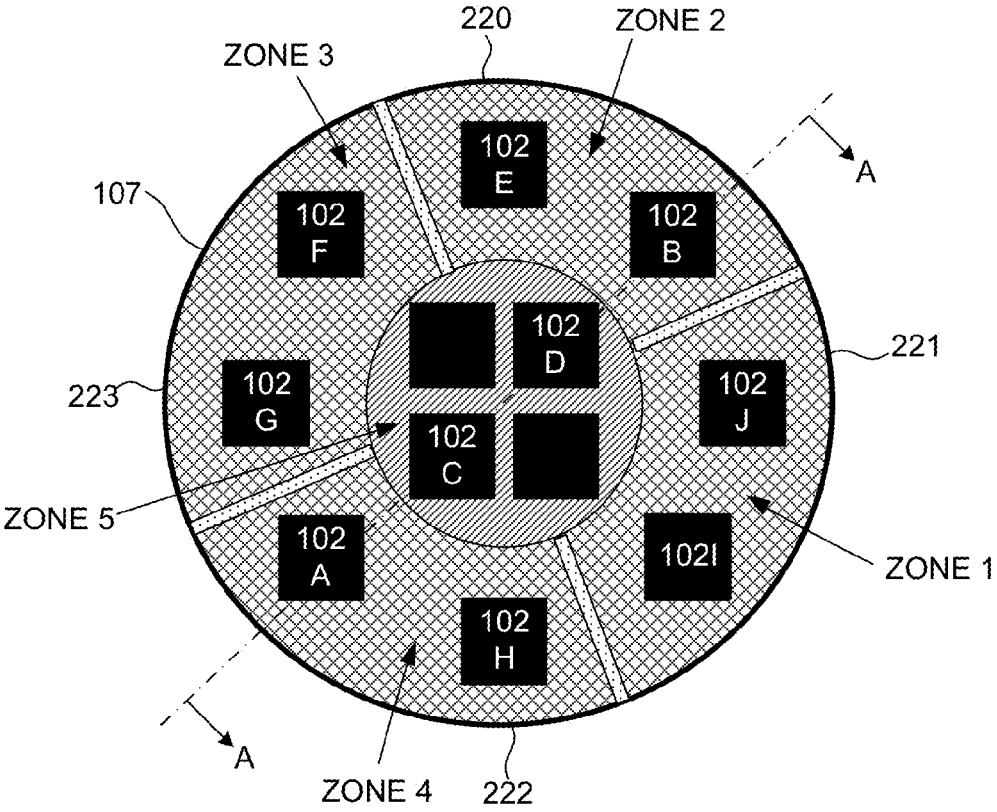
FIG. 10 is illustrative of a top view of an LED based illumination module that is divided into five zones.

As depicted in FIG. 9, LED based illumination module is divided into two zones. However, more zones may be contemplated. For example, as depicted in FIG. 10, LED based illumination module is divided into five zones. Zones 1-4 subdivide sidewall 107 into a number of distinct color converting surfaces. In this manner light emitted from LEDs 1021 and 102J in zone 1 is preferentially directed to color converting surface 221 of sidewall 107, light emitted from LEDs 102B and 102E in zone 2 is preferentially directed to color converting surface 220 of sidewall 107, light emitted from LEDs 102F and 102G in zone 3 is preferentially directed to color converting surface 223 of sidewall 107, and light emitted from LEDs 102A and 102H in zone 4 is preferentially directed to color converting surface 222 of sidewall 107. The five zone configuration depicted in FIG. 10 is provided by way of example. However, many other numbers and combinations of zones may be contemplated.

In one embodiment, color converting surfaces zones 221 and 223 in zones 1 and 3, respectively may include a densely packed yellow and/or green emitting phosphor, while color converting surfaces 220 and 222 in zones 2 and 4, respectively, may include a sparsely packed yellow and/or green emitting phosphor. In this manner, blue light emitted from LEDs in zones 1 and 3 may be almost completely converted to yellow and/or green light, while blue light emitted from LEDs in zones 2 and 4 may only be partially converted to yellow and/or green light. In this manner, the amount of blue light contribution to combined light 141 may be controlled by independently controlling the current supplied to LEDs in zones 1 and 3 and to LEDs in zones 2 and 4. More specifically, if a relatively large contribution of blue light to combined light 141 is desired, a large current may be supplied to LEDs in zones 2 and 4, while a current supplied to LEDs in zones 1 and 3 is minimized. However, if relatively small contribution of blue light is desired, only a limited current may be supplied to LEDs in zones 2 and 4, while a large current is supplied to LEDs in zones 1 and 3. In this manner, the relative contributions of blue light and yellow and/or green light to combined light 141 may be independently controlled. This may be useful to tune the light output generated by LED based illumination module to match a desired dimming characteristic (e.g., line 202). The aforementioned embodiment is provided by way of example. Many other combinations of different zones of independently controlled LEDs preferentially illuminating different color converting surfaces may be contemplated to a desired dimming characteristic.

In some embodiments, the locations of LEDs 102 within LED based illumination module are selected to achieve uniform light emission properties of combined light 141. In some embodiments, the location of LEDs 102 may be symmetric about an axis in the mounting plane of LEDs 102 of LED based illumination module. In some embodiments, the location of LEDs 102 may be symmetric about an axis perpendicular to the mounting plane of LEDs 102. Light emitted from some LEDs 102 is preferentially directed toward an interior surface or a number of interior surfaces and light emitted from some other LEDs 102 is preferentially directed toward another interior surface or number of interior surfaces of color conversion cavity 160. The proximity of LEDs 102 to sidewall 107 may be selected to promote efficient light extraction from color conversion cavity 160 and uniform light emission properties of combined light 141. In such embodiments, light emitted from LEDs 102 closest to sidewall 107 is preferentially directed toward sidewall 107. However, in some embodiments, light emitted from LEDs close to sidewall 107 may be directed toward output window 108 to avoid an excessive amount of color conversion due to interaction with sidewall 107. Conversely, in some other embodiments, light emitted from LEDs distant from sidewall 107 may be preferentially directed toward sidewall 107 when additional color conversion due to interaction with sidewall 107 is necessary.

Figure 11:
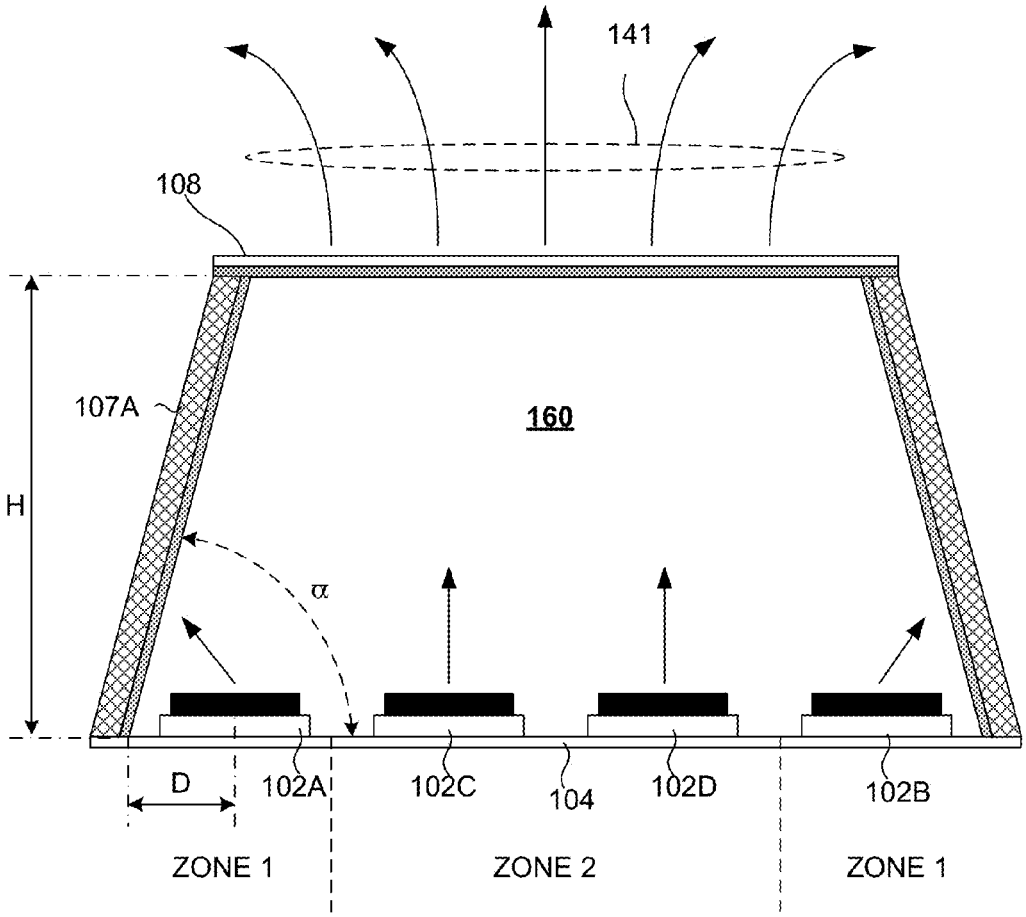
FIG. 11 is illustrative of a cross-section of an LED based illumination module in another embodiment.

FIG. 11 is illustrative of a cross-section of LED based illumination module in another embodiment. In the illustrated embodiment, sidewalls 107A are disposed at an oblique angle, α, with respect to mounting board 104. In this manner, a higher percentage of light emitted from LEDs in preferential zone 1 (e.g., LEDs 102A and 102B) directly illuminates sidewall 107A. In some embodiments, more than fifty percent of the light output by LEDs 102A and 102B is directed to sidewall 107A. For example, as illustrated in FIG. 11, LEDs in zone 1 (e.g., LED 102A) are located a distance, D, from sidewall 107A. In addition, sidewall 107A extends a distance, H, from mounting board 104 to output window 108. Assuming that LED 102A exhibits an axi-symmetric output beam distribution and oblique angle, α, is chosen as follows:

$$\alpha \leq \tan^{-1}\left(\frac{H}{D}\right) \tag{1}$$

then more than fifty percent of the light output by LEDs in zone 1 is directed to sidewall 107A. In some other embodiments, oblique angle, α, is selected such that more than seventy five percent of the light output by LEDs in zone 1 is directed to sidewall 107A. In some other embodiments, oblique angle, cc, is selected such that more than ninety percent of the light output by LEDs in zone 1 is directed to sidewall 107A.

Figure 12:
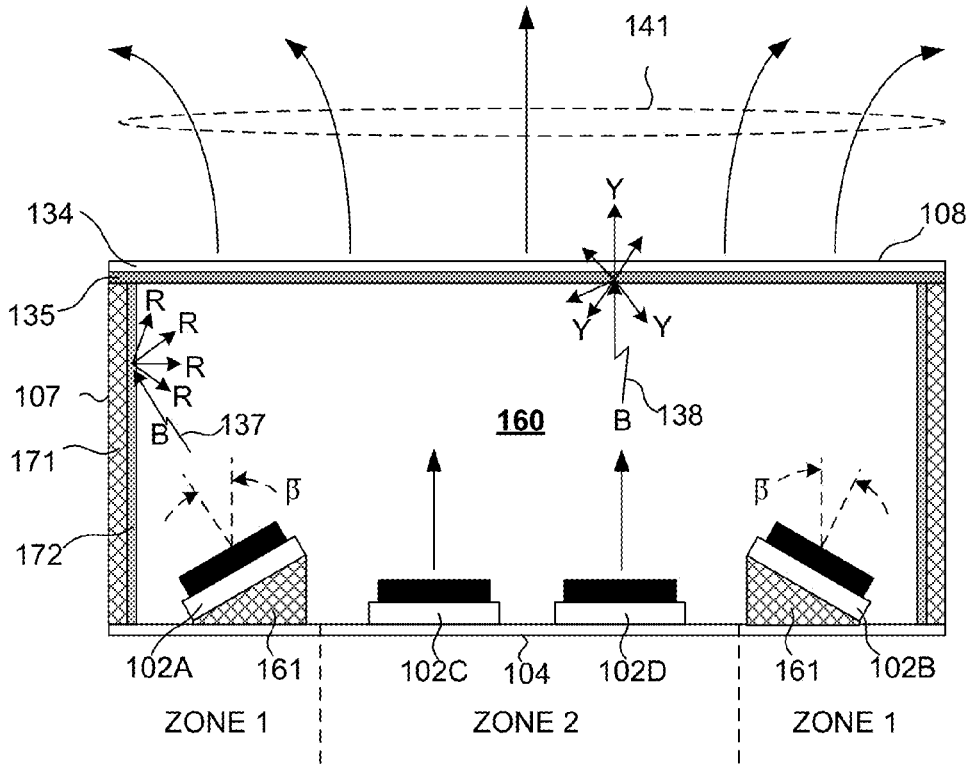
FIG. 12 is illustrative of a cross-section of an LED based illumination module in another embodiment.

FIG. 12 is illustrative of a cross-section of LED based illumination module in another embodiment. In the illustrated embodiment, LEDs 102 located in preferential zone 1 (e.g., LEDs 102A and 102B) are mounted at an oblique angle, β, with respect to LEDs in preferential zone 2. In this manner, a higher percentage of light emitted from LEDs in preferential zone 1 directly illuminates sidewall 107. In the illustrated embodiment, an angled mounting pad 161 is employed to mount LEDs in preferential zone 1 at an oblique angle with respect to mounting board 104. In another example (not shown), LEDs in preferential zone 1 may be mounted to a three dimensional mounting board that includes a mounting surface(s) for LEDs in preferential zone 1 oriented at an oblique angle with respect to a mounting surface(s) for LEDs in preferential zone 2. In yet another example, mounting board 104 may be deformed after being populated with LEDs 102 such that LEDs in preferential zone 1 are oriented at an oblique angle with respect to LEDs in preferential zone 2. In yet another example, LEDs in preferential zone 1 may be mounted to a separate mounting board. The mounting board including LEDs in preferential zone 1 may be oriented at an oblique angle with respect to the mounting board including LEDs in preferential zone 2. Other embodiments may be contemplated. In some embodiments, oblique angle, β, is selected such that more than fifty percent of the light output by LEDs 102A and 102B is directed to sidewall 107. In some other embodiments, oblique angle, β, is selected such that more than seventy five percent of the light output by LEDs 102A and 102B is directed to sidewall 107. In some other embodiments, oblique angle, β, is selected such that more than ninety percent of the light output by LEDs 102A and 102B is directed to sidewall 107.

Figure 13:
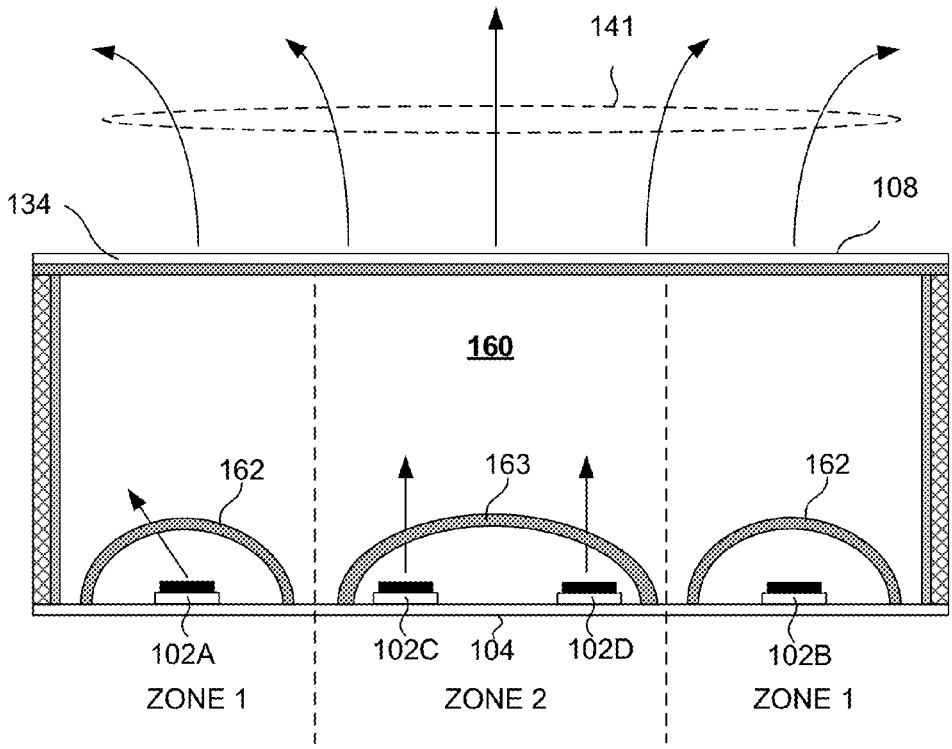
FIG. 13 is illustrative of a cross-section of an LED based illumination module in another embodiment.

FIG. 13 is illustrative of a cross-section of LED based illumination module in another embodiment. In the illustrated embodiment, a transmissive element 162 is disposed above and separated from LEDs 102A and 102B. As illustrated, transmissive element 162 is located between LED 102A and output window 108. In some embodiments, transmissive element 162 includes the same wavelength converting material as the material included with sidewall 107. In the aforementioned embodiment, blue light emitted from LEDs in preferential zone 1 is preferentially directed to sidewall 107 and interacts with a red phosphor located in color converting layer 172 to generate red light. To enhance the conversion of blue light to red light, a transmissive element 162 including the red phosphor of color converting layer 172 may be disposed above any of the LEDs located in preferential zone 1. In this manner, light emitted from any of the LEDs located in preferential zone 1 is preferentially directed to transmissive element 162. In addition, light emitted from transmissive element 162 may be preferentially directed to sidewall 107 for additional conversion to red light.

In some embodiments, a transmissive element 163 including a yellow and/or green phosphor may also be disposed above any of the LEDs located in preferential zone 2. In this manner, light emitted from any of the LEDs located in preferential zone 2 is more likely to undergo color conversion before exiting LED based illumination module as part of combined light 141.

In some other embodiments, transmissive element 162 includes a different wavelength converting material from the wavelength converting materials included in sidewall 107 and output window 108. In some embodiments, a transmissive element 162 may be located above some of the LEDs in any of preferential zones 1 and 2. In some embodiments, transmissive element 162 is a dome shaped element disposed over an individual LED 102. In some other embodiments, transmissive element 162 is a shaped element disposed over a number of LEDs 102 (e.g., a bisected toroid shape disposed over the LEDs 102 in preferential zone 1 of a circular shaped LED based illumination module, or a linearly extending shape disposed over a number of LEDs 102 arranged in a linear pattern).

In some embodiments, the shape of transmissive element 162 disposed above LEDs 102 located in preferential zone 1 is different than the shape of a transmissive element 162 disposed above LEDs 102 located in preferential zone 2.

For example, the shape of transmissive element 162 disposed above LEDs 102 located in preferential zone 1 is selected such that light emitted from LEDs located in preferential zone 1 preferentially illuminates sidewall 107. In some embodiments, transmissive element 162 is selected such that more than fifty percent of the light output by LEDs located in preferential zone 1 is directed to sidewall 107. In some other embodiments, transmissive element 162 is selected such that more than seventy five percent of the light output by LEDs located in preferential zone 1 is directed to sidewall 107. In some other embodiments, transmissive element 162 is selected such that more than ninety percent of the light output by LEDs located in preferential zone 1 is directed to sidewall 107.

Similarly, any transmissive element disposed above LEDs 102 located in preferential zone 2 is shaped to preferentially illuminate output window 108. In some embodiments, transmissive element 163 is selected such that more than fifty percent of the light output by LEDs located in preferential zone 2 is directed to output window 108. In some other embodiments, transmissive element 163 is selected such that more than seventy five percent of the light output by LEDs located in preferential zone 2 is directed to output window 108. In some other embodiments, transmissive element 163 is selected such that more than ninety percent of the light output by LEDs located in preferential zone 2 is directed to output window 108.

Figure 14:
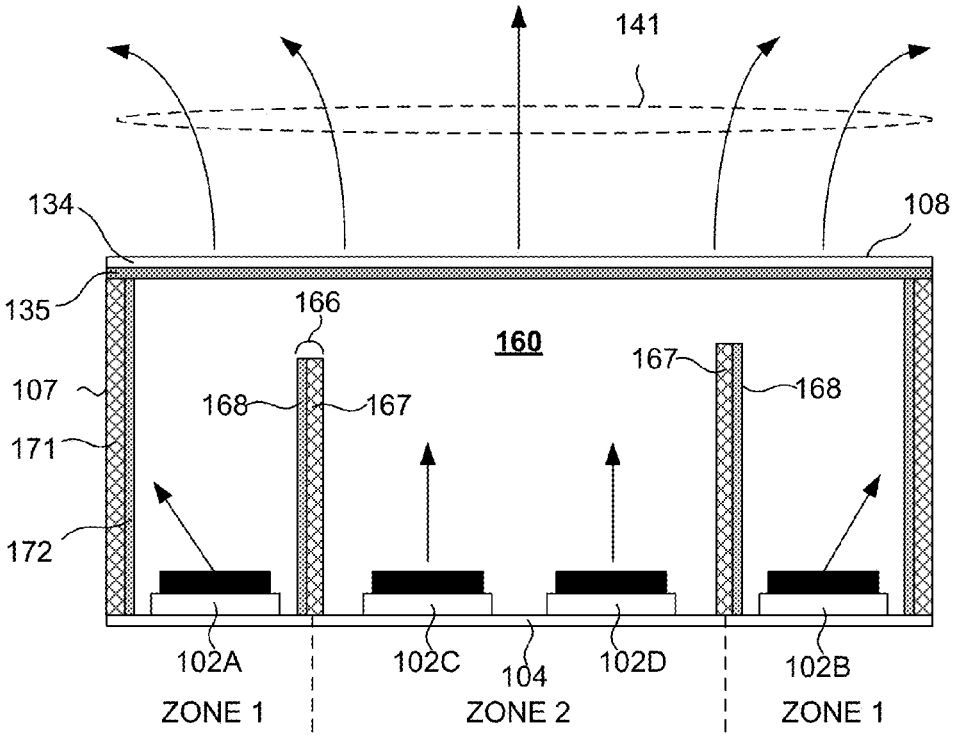
FIG. 14 is illustrative of a cross-section of an LED based illumination module in another embodiment.

FIG. 14 is illustrative of a cross-section of LED based illumination module in another embodiment. In the illustrated embodiment, an interior surface 166 extends from mounting board 104 toward output window 108. In some embodiments, the height, H, of surface 166 is determined such that at least fifty percent of the light emitted from LEDs in preferential zone 1 directly illuminates either sidewall 107 or interior surface 166. In some other embodiments, the height, H, of interior surface 166 is determined such that at least seventy five percent of the light emitted from LEDs in preferential zone 1 directly illuminates either sidewall 107 or interior surface 166. In yet some other embodiments, the height, H, of interior surface 166 is determined such that at least ninety percent of the light emitted from LEDs in preferential zone 1 directly illuminates either sidewall 107 or interior surface 166.

In some embodiments, interior surface 166 includes a reflective surface 167 and a color converting layer 168. In the illustrated embodiment, color converting layer 168 is located on the side of reflective surface 167 that faces sidewall 107. In addition, color converting layer 168 includes the same wavelength converting material included in color converting layer 172 of sidewall 107. In this manner, light emitted from LEDs located in preferential zone 1 is preferentially directed to sidewall 107 and interior surface 166 for enhanced color conversion. In some other embodiments, color converting layer 168 includes a different wavelength converting material than that included in color converting layer 172.

Figure 15:
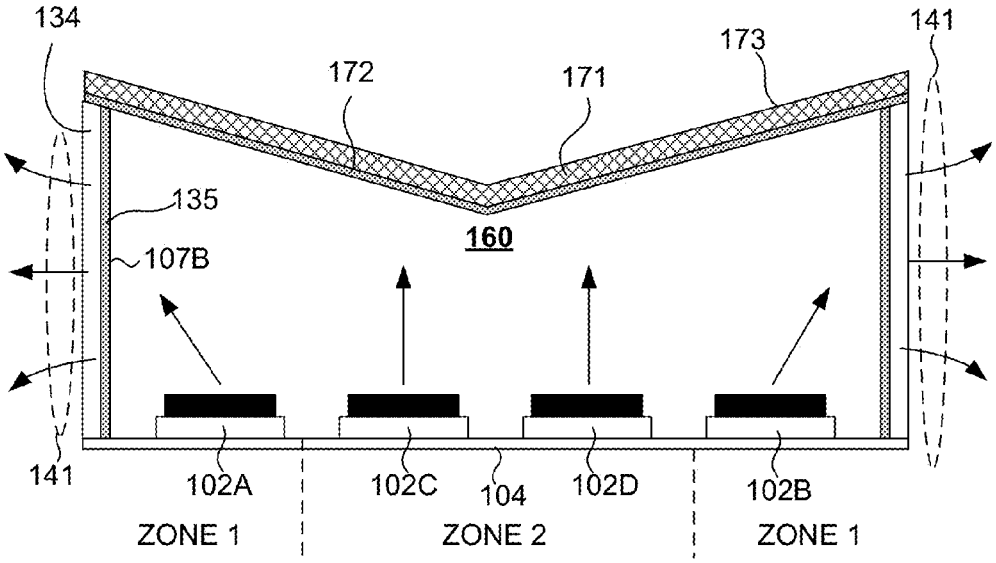
FIG. 15 is illustrative of a cross-section of an LED based illumination module in another embodiment.

FIG. 15 illustrates an example of a side emitting LED based illumination module that preferentially directs light emitted from LEDs 102A and 102B toward sidewall 107 and preferentially directs light emitted from LEDs 102C and 102D toward top wall 173. In side-emitting embodiments, combined light 141 is emitted from LED based illumination module through transmissive sidewall 107. In some embodiments, top wall 173 is reflective and is shaped to direct light toward sidewall 107.

Figure 16:
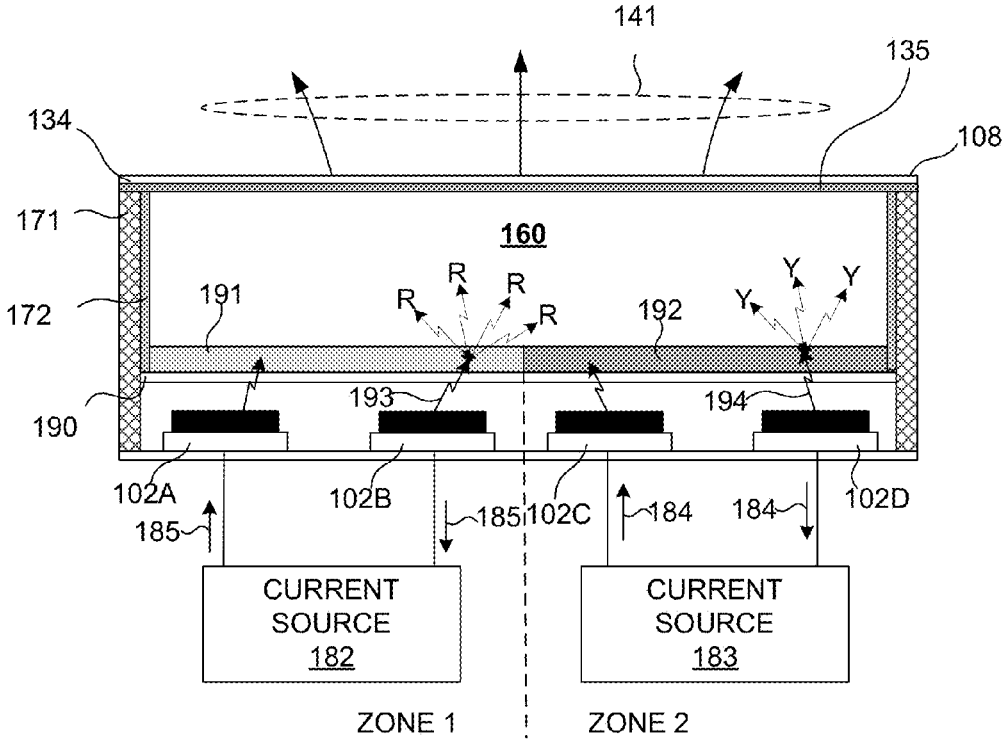
FIG. 16 is illustrative of a cross-sectional, side view of an LED based illumination module in another embodiment.

FIG. 16 is illustrative of a cross-sectional, side view of an LED based illumination module in one embodiment. As illustrated, LED based illumination module includes a plurality of LEDs 102A-102D, a sidewall 107 and an output window 108. Sidewall 107 includes a reflective layer 171 and a color converting layer 172. Color converting layer 172 includes a wavelength converting material (e.g., a red-emitting phosphor material). Output window 108 includes a transmissive layer 134 and a color converting layer 135. Color converting layer 135 includes a wavelength converting material with a different color conversion property than the wavelength converting material included in sidewall 107 (e.g., a yellow-emitting phosphor material). LED based illumination module also includes a transmissive element 190 disposed above LEDs 102A-102D. As depicted transmissive element 190 is physically separated from the light emitting surfaces of the LEDs 102. However, in some other embodiments, transmissive element 190 is physically coupled to the light emitting surfaces of the LEDs 102 by an optically transmissive medium (e.g., silicone, optical adhesive, etc.). As depicted, transmissive element 190 is a plate of optically transmissive material (e.g., glass, sapphire, alumina, polycarbonate, and other plastics etc.). However, any other shape may be contemplated. As depicted in FIG. 16, color conversion cavity 160 is formed by the interior surfaces of the LED based illumination module including the interior surface of sidewall 107, the interior surface of output window 108, and transmissive element 190. As such, LEDs 102 are physically separated from color conversion cavity 160. By spacing the wavelength converting materials from LEDs 102, heat from the LEDs 102 to the wavelength converting materials is decreased. As a result, the wavelength converting materials are maintained at a lower temperature during operation. This increases the reliability and color maintenance of the LED based illumination device 100.

In some embodiments, color converting layers 172 and 135 are not included in LED based illumination device 100. In these embodiments, substantially all of color conversion is achieved by phosphors included with transmissive element 190.

Transmissive element 190 includes a first surface area with a first wavelength converting material 191 and a second surface area with a second wavelength converting material 192. The wavelength converting materials 191 and 192 may be disposed on transmissive element 190 or embedded within transmissive element 190. Additional wavelength converting materials may also be included as part of transmissive element 190. For example, additional surface areas of transmissive element 190 may include additional wavelength converting materials. In some examples, different wavelength converting materials may be layered on transmissive element 190. As depicted in FIG. 16, wavelength converting material 191 is a red emitting phosphor that is preferentially illuminated by LEDs 102A and 102B. In addition, wavelength converting material 192 is a yellow emitting phosphor that is preferentially illuminated by LEDs 102C and 102D.

The LEDs 102A-102D of LED based illumination module emit light directly into color conversion cavity 160. Light is mixed and color converted within color conversion cavity 160 and the resulting combined light 141 is emitted by LED based illumination module. A different current source supplies current to LEDs 102 in different preferential zones. In the example depicted in FIG. 16, current source 182 supplies current 185 to LEDs 102A and 102B located in preferential zone 1. Similarly, current source 183 supplies current 184 to LEDs 102C and 102D located in preferential zone 2. By separately controlling the current supplied to LEDs located in different preferential zones, the correlated color temperatures (CCT) of combined light 141 output by LED based illumination module may be adjusted over a broad range of CCTs. In some embodiments, the LEDs 102 of LED based illumination device emit light with a peak emission wavelength within five nanometers of each other. For example, LEDs 102A-D all emit blue light with a peak emission wavelength within five nanometers of each other. In this manner, white light emitted from LED based illumination device 100 is generated in large part by wavelength converting materials. Thus, color control is based on the arrangement of different wavelength converting materials to be preferentially illuminated by different subsets of LEDs.

Figure 17:
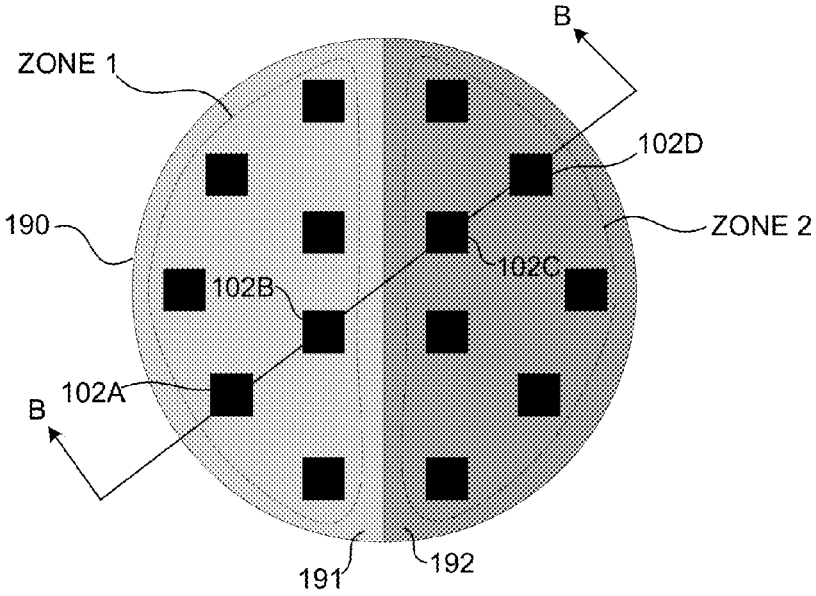
FIG. 17 is illustrative of a top view of the LED based illumination module depicted in FIG. 16.

FIG. 17 illustrates a top view of the LED based illumination module depicted in FIG. 16. FIG. 16 depicts a cross-sectional view of LED based illumination device 100 along section line, B, depicted in FIG. 17. As illustrated in FIG. 17, wavelength converting material 191 covers a portion of transmissive element 190 and wavelength converting material 192 covers another portion of transmissive element 190. LEDs in zone 2 (including LEDs 102A and 102B) preferentially illuminate wavelength converting material 191. Similarly, LEDs in zone 1 (including LEDs 102C and 102D) preferentially illuminate wavelength converting material 192. In some embodiments, more than fifty percent of the light output by LEDs in zone 1 is directed to wavelength converting material 191, while more than fifty percent of the light output by LEDS in zone 2 is directed to wavelength converting material 192. In some other embodiments, more than seventy five percent of the light output by LEDs in zone 1 is directed to wavelength converting material 191, while more than seventy five percent of the light output by LEDS in zone 2 is directed to wavelength converting material 192. In some other embodiments, more than ninety percent of the light output by LEDs in zone 1 is directed to wavelength converting material 191, while more than ninety percent of the light output by LEDS in zone 2 is directed to wavelength converting material 192.

In one embodiment, light emitted from LEDs located in preferential zone 1 is directed to wavelength converting material 191 that includes a mixture of red and yellow emitting phosphor materials. When current source 182 supplies current 185 to LEDs in preferential zone 1, the light output 141 is a light with a correlated color temperature (CCT) less than 7,500 Kelvin. In some other examples, the light output has a CCT less than 5,000 Kelvin. In some embodiments, the light output has a color point within a degree of departure $\Delta xy$ of 0.010 from a target color point in the CIE 1931 xy diagram created by the International Commission on Illumination (CIE) in 1931. Thus, when current is supplied to LEDs in preferential zone 1 and substantially no current is supplied to LEDs in preferential zone 2, the combined light output 141 from LED based illumination module is white light that meets a specific color point target (e.g., within a degree of departure $\Delta xy$ of 0.010 within 3,000 Kelvin on the Planckian locus). In some embodiments, the light output has a color point within a degree of departure Δxy of 0.004 from a target color point in the CIE 1931 xy diagram. In this manner, there is no need to tune multiple currents supplied to different LEDs of LED based illumination device 100 to achieve a white light output that meets the specified color point target.

Wavelength converting material 192 includes a red emitting phosphor material. When current source 183 supplies current 184 to LEDs in preferential zone 2, the light output has a relatively low CCT. In some examples the light output has a CCT less than 2,200 Kelvin. In some other examples, the light output has a CCT less than 2,000 Kelvin. In some other examples, the light output has a CCT less than 1,800 Kelvin. Thus, when current is supplied to LEDs in preferential zone 2 and substantially no current is supplied to LEDs in preferential zone 1, the combined light output 141 from LED based illumination module is a very warm colored light. By adjusting the current 185 supplied to LEDs located in zone 1 relative to the current 184 supplied to LEDs located in zone 2, the amount of white light relative to colored light included in combined light 141 may be adjusted. Thus, control of currents 184 and 185 may be used to tune the CCT of light emitted from LED based illumination module from a relatively high CCT to a relatively low CCT. In some examples, control of currents 184 and 185 may be used to tune the CCT of light emitted from LED based illumination module from a white light of at least 2,700 Kelvin to a warm light below 1,800 Kelvin). In some other examples, a warm light below 1,700 Kelvin is achieved.

Figure 18:
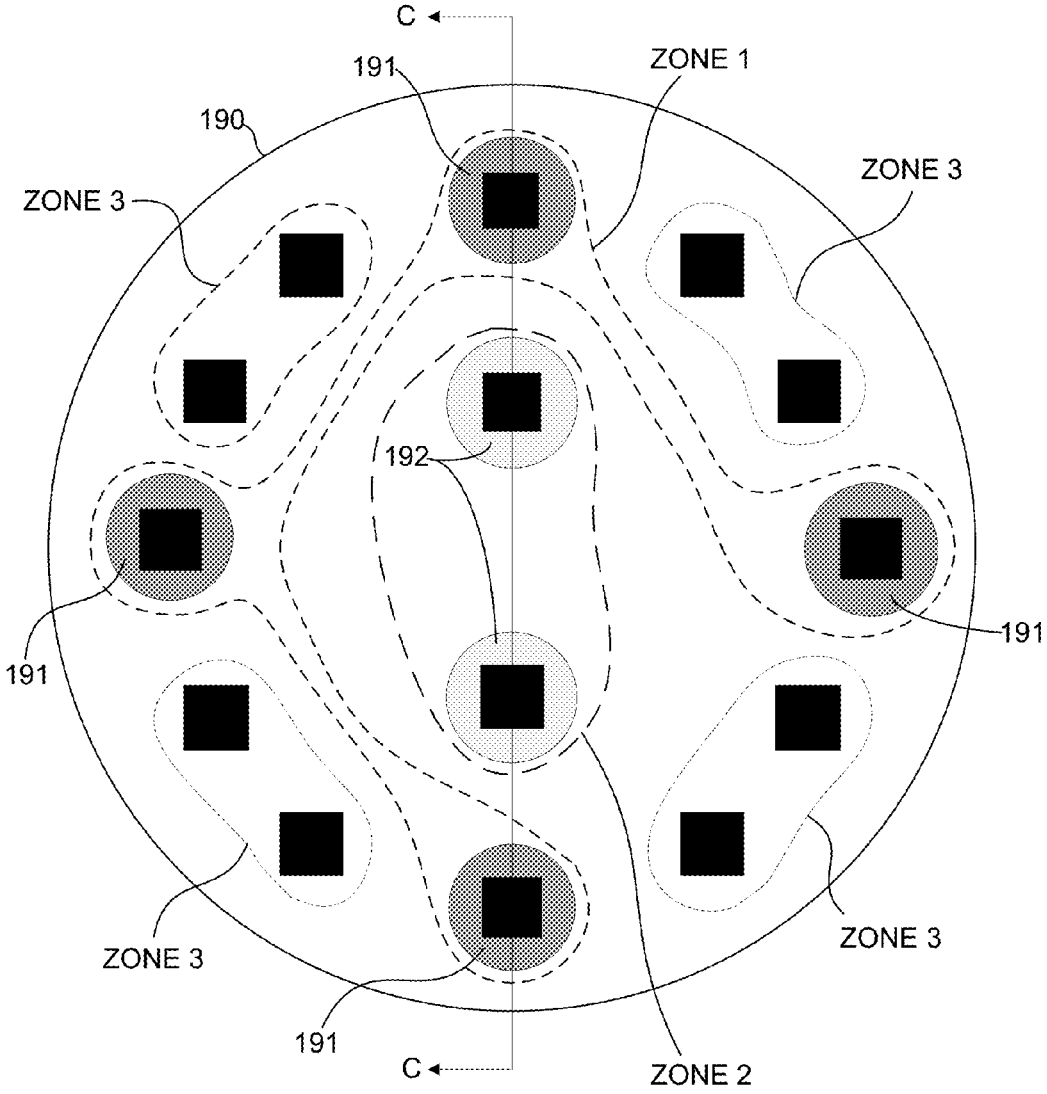
FIG. 18 is illustrative of a top view of an LED based illumination module in another embodiment.
Figure 19:
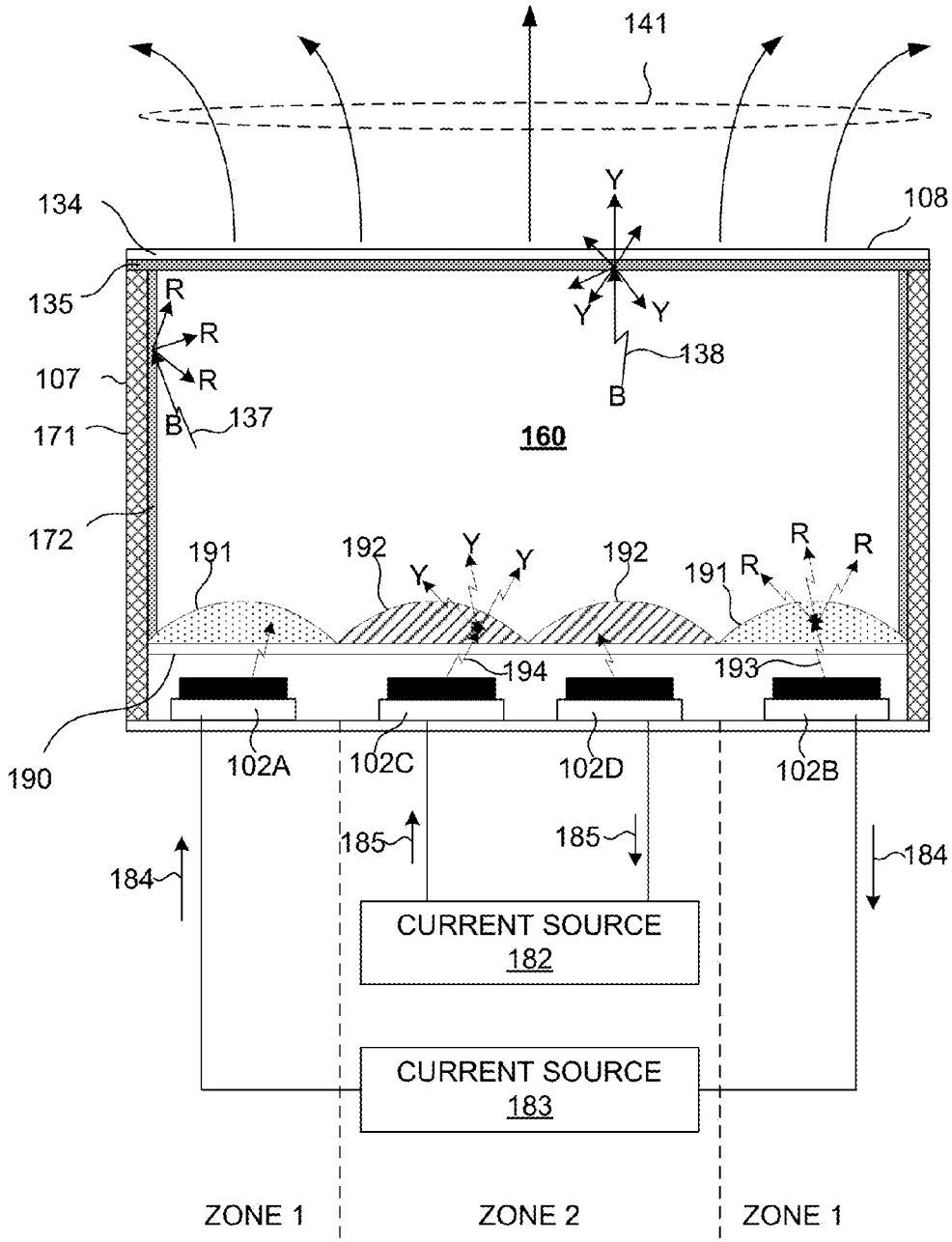
FIG. 19 is illustrative of a cross-sectional, side view of the LED based illumination module depicted in FIG. 18.

FIG. 18 illustrates a top view of the LED based illumination module in another embodiment. FIG. 19 depicts a cross-sectional view of LED based illumination device 100 along section line, C, depicted in FIG. 18. As illustrated in FIG. 18, wavelength converting material 191 covers a portion of transmissive element 190 and is preferentially illuminated by LEDs in zone 1. Wavelength converting material 192 covers another portion of transmissive element 190 and is preferentially illuminated by LEDs in zone 2. LEDs in zone 3 do not preferentially illuminate either of wavelength converting materials 191 or 192. LEDs in zone 3, preferentially illuminate wavelength converting materials present in color converting layers 135 and 172. In this embodiment, color converting layer 172 includes a red-emitting phosphor material and color converting layer 135 includes a yellow emitting phosphor material. However, other combinations of phosphor materials may be contemplated. In some other embodiments, color converting layers 135 and 172 are not implemented. In these embodiments, color conversion is performed by wavelength conversion materials included on transmissive element 190, rather than sidewalls 107 or output window 108.

Figure 20:
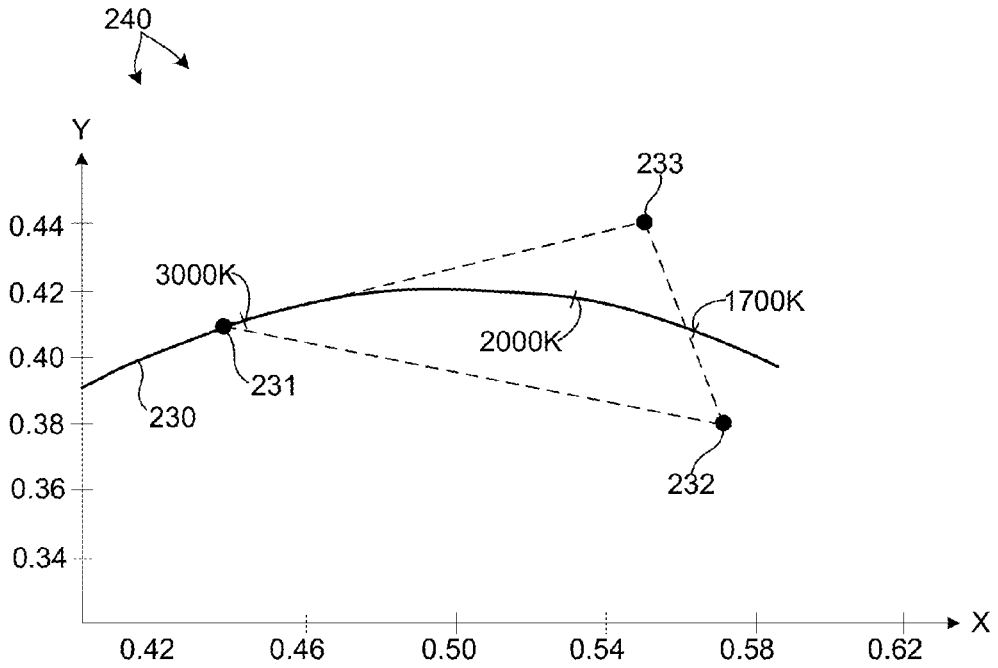
FIG. 20 illustrates a plot of xy color coordinates in the 1931 CIE color space achieved by the embodiment of the LED based illumination device 100 illustrated in FIGS. 18-19.

FIG. 20 illustrates a range of color points achievable by the LED based illumination device 100 depicted in FIGS. 18 and 19. When a current is supplied to LEDs in zone 3, light 141 emitted from LED based illumination device 100 has a color point 231 illustrated in FIG. 20. Light emitted from LED based illumination device 100 has a color point within a degree of departure Δxy of 0.010 in the CIE 1931 xy diagram from a target color point of less than 5,000 Kelvin on the Planckian locus when current is supplied to LEDs in zone 3 and substantially no current is supplied to LEDs in zones 1 and 2. When current source 183 supplies current 184 to LEDs in preferential zone 1, the light emitted from LED based illumination device 100 has a color point 232. Light emitted from LED based illumination device 100 has a color point below the Planckian locus in the CIE 1931 xy diagram with a CCT less than 1,800 Kelvin when current is supplied to LEDs in zone 1 and substantially no current is supplied to LEDs in zones 2 and 3. When current source 182 supplies current 185 to LEDs in preferential zone 2, the light emitted from LED based illumination device 100 has a color point 233. Light emitted from LED based illumination device 100 has a color point above the Planckian locus 230 in the CIE 1931 xy diagram 240 with a CCT less than 3,000 Kelvin when current is supplied to LEDs in zone 2 and substantially no current is supplied to LEDs in zones 1 and 3.

By adjusting the currents supplied to LEDs located in zones 1, 2, and 3, the light 141 emitted from LED based illumination module can be tuned to any color point within a triangle connecting color points 231-233 illustrated in FIG. 20. In this manner, the light 141 emitted from LED based illumination module can be tuned to achieve any CCT from a relatively high CCT (e.g., approximately 3,000 Kelvin) to a relatively low CCT (e.g., below 1,800 Kelvin).

As illustrated in FIG. 6, plotline 203 exhibits one achievable relationship between CCT and relative flux for the embodiment illustrated in FIGS. 18-19. As illustrated in FIG. 6, it is possible to reduce the CCT of light emitted from LED based illumination device 100 from 3,000 Kelvin to approximately 2,200 Kelvin without a loss of flux. Further reductions in CCT can be obtained from 2,200 Kelvin to approximately 1,750 Kelvin with an approximately linear reduction in relative flux from 100% to 55%. Relative flux can be further reduced without a change in CCT by reducing current supplied to LEDs of LED based illumination device 100. Plotline 203 is presented by way of example to illustrate that LED based illumination device 100 may be configured to achieve relatively large changes in CCT with relatively small changes in flux levels (e.g., as illustrated in line 203 from 55-100% relative flux) and also achieve relatively large changes in flux level with relatively small changes in CCT (e.g., as illustrated in line 203 from 0-55% relative flux). However, many other dimming characteristics may be achieved by reconfiguring both the relative and absolute currents supplied to LEDs in different preferential zones.

The aforementioned embodiment is provided by way of example. Many other combinations of different zones of independently controlled LEDs preferentially illuminating different color converting surfaces may be contemplated to a desired dimming characteristic.

In some embodiments, components of color conversion cavity 160 including angled mounting pad 161 may be constructed from or include a PTFE material. In some examples the component may include a PTFE layer backed by a reflective layer such as a polished metallic layer. The PTFE material may be formed from sintered PTFE particles. In some embodiments, portions of any of the interior facing surfaces of color converting cavity 160 may be constructed from a PTFE material. In some embodiments, the PTFE material may be coated with a wavelength converting material. In other embodiments, a wavelength converting material may be mixed with the PTFE material.

In other embodiments, components of color conversion cavity 160 may be constructed from or include a reflective, ceramic material, such as ceramic material produced by CerFlex International (The Netherlands). In some embodiments, portions of any of the interior facing surfaces of color converting cavity 160 may be constructed from a ceramic material. In some embodiments, the ceramic material may be coated with a wavelength converting material.

In other embodiments, components of color conversion cavity 160 may be constructed from or include a reflective, metallic material, such as aluminum or Miro® produced by Alanod (Germany). In some embodiments, portions of any of the interior facing surfaces of color converting cavity 160 may be constructed from a reflective, metallic material. In some embodiments, the reflective, metallic material may be coated with a wavelength converting material.

In other embodiments, (components of color conversion cavity 160 may be constructed from or include a reflective, plastic material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In some embodiments, portions of any of the interior facing surfaces of color converting cavity 160 may be constructed from a reflective, plastic material. In some embodiments, the reflective, plastic material may be coated with a wavelength converting material.

Cavity 160 may be filled with a non-solid material, such as air or an inert gas, so that the LEDs 102 emits light into the non-solid material. By way of example, the cavity may be hermetically sealed and Argon gas used to fill the cavity. Alternatively, Nitrogen may be used. In other embodiments, cavity 160 may be filled with a solid encapsulate material. By way of example, silicone may be used to fill the cavity. In some other embodiments, color converting cavity 160 may be filled with a fluid to promote heat extraction from LEDs 102. In some embodiments, wavelength converting material may be included in the fluid to achieve color conversion throughout the volume of color converting cavity 160.

The PTFE material is less reflective than other materials that may be used to construct or include in components of color conversion cavity 160 such as Miro® produced by Alanod. In one example, the blue light output of an LED based illumination module constructed with uncoated Miro® sidewall insert 107 was compared to the same module constructed with an uncoated PTFE sidewall insert 107 constructed from sintered PTFE material manufactured by Berghof (Germany). Blue light output from module was decreased 7% by use of a PTFE sidewall insert. Similarly, blue light output from module was decreased 5% compared to uncoated Miro® sidewall insert 107 by use of an uncoated PTFE sidewall insert 107 constructed from sintered PTFE material manufactured by W.L. Gore (USA). Light extraction from the module is directly related to the reflectivity inside the cavity 160, and thus, the inferior reflectivity of the PTFE material, compared to other available reflective materials, would lead away from using the PTFE material in the cavity 160. Nevertheless, the inventors have determined that when the PTFE material is coated with phosphor, the PTFE material unexpectedly produces an increase in luminous output compared to other more reflective materials, such as Miro®, with a similar phosphor coating. In another example, the white light output of an illumination module targeting a correlated color temperature (CCT) of 4,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module was increased 7% by use of a phosphor coated PTFE sidewall insert compared to phosphor coated Miro®. Similarly, white light output from module was increased 14% compared to phosphor coated Miro® sidewall insert 107 by use of a PTFE sidewall insert 107 constructed from sintered PTFE material manufactured by W.L. Gore (USA). In another example, the white light output of an illumination module targeting a correlated color temperature (CCT) of 3,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module was increased 10% by use of a phosphor coated PTFE sidewall insert compared to phosphor coated Miro®. Similarly, white light output from module was increased 12% compared to phosphor coated Miro® sidewall insert 107 by use of a PTFE sidewall insert 107 constructed from sintered PTFE material manufactured by W.L. Gore (USA).

Thus, it has been discovered that, despite being less reflective, it is desirable to construct phosphor covered portions of the light mixing cavity 160 from a PTFE material. Moreover, the inventors have also discovered that phosphor coated PTFE material has greater durability when exposed to the heat from LEDs, e.g., in a light mixing cavity 160, compared to other more reflective materials, such as Miro®, with a similar phosphor coating.

Although certain specific embodiments are described above for instructional purposes, the teachings of this patent document have general applicability and are not limited to the specific embodiments described above. For example, any component of color conversion cavity 160 may be patterned with phosphor. Both the pattern itself and the phosphor composition may vary. In one embodiment, the illumination device may include different types of phosphors that are located at different areas of a light mixing cavity 160. For example, a red phosphor may be located on either or both of the insert 107 and the bottom reflector insert 106 and yellow and green phosphors may be located on the top or bottom surfaces of the output window 108 or embedded within the output window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 120 may be a single component. In another example, LED based illumination module 100 is depicted in FIGS. 1-3 as a part of a luminaire 150. As illustrated in FIG. 3, the LED based illumination module may be a part of a replacement lamp or retrofit lamp. But, in another embodiment, LED based illumination module may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. An LED based illumination device, comprising:

a color conversion cavity comprising a first surface area including a first wavelength converting material and a second surface area including a second wavelength converting material;

a first LED configured to receive a first current, wherein light emitted from the first LED enters the color conversion cavity and preferentially primarily illuminates the first wavelength converting material, the first wavelength converting material is physically separated from a light emitting surface of the first LED, wherein a light emitted from the LED based illumination device based on the light emitted from the first LED has a first color temperature;

a second LED configured to receive a second current, wherein light emitted from the second LED enters the color conversion cavity and preferentially primarily illuminates the second wavelength converting material, the second wavelength converting material is physically separated from a light emitting surface of the second LED, wherein a light emitted from the LED based illumination device based on light emission from the second LED has a second color temperature that is different than the first color temperature;

wherein the second LED is mounted to a mounting board at an oblique angle with respect to the first LED; and wherein the first current and the second current are selectable to achieve a range of correlated color temperature (CCT) of light output by the LED based illumination device.

2. The LED based illumination device of claim 1, wherein the first surface area is a transmissive output window and the second surface area is a reflective sidewall.

3. An LED based illumination device, comprising:

a color conversion cavity comprising a first surface area including a first wavelength converting material and a second surface area including a second wavelength converting material;

a first LED configured to receive a first current, wherein light emitted from the first LED enters the color conversion cavity and primarily illuminates the first wavelength converting material, the first wavelength converting material is physically separated from a light emitting surface of the first LED, wherein a light emitted from the LED based illumination device based on the light emitted from the first LED has a first color temperature;

a second LED configured to receive a second current, wherein light emitted from the second LED enters the color conversion cavity and primarily illuminates the second wavelength converting material, the second wavelength converting material is physically separated from a light emitting surface of the second LED, wherein a light emitted from the LED based illumination device based on light emission from the second LED has a second color temperature that is different than the first color temperature;

wherein the first current and the second current are selectable to achieve a range of correlated color temperature (CCT) of light output by the LED based illumination device; and an output window over an output port of the color conversion cavity, the output window comprising at least one of the first wavelength converting material and the second wavelength converting material, wherein the color conversion cavity is configured to mix a first light emitted from the first LED and converted by the first wavelength converting material with a second light emitted from the second LED and converted by the second wavelength converting material to produce a combined light that is emitted through the output window.

4. The LED based illumination device of claim 3, wherein the second LED and the second wavelength converting material are configured to produce a color point of the light emitted from the LED based illumination device that is within a degree of departure $\Delta xy$ of 0.010 from a target color point in a CIE 1931 xy diagram when the second current is supplied to the second LED and the first current is substantially zero.

5. The LED based illumination device of claim 3, wherein the first wavelength converting material and the second wavelength converting material are included as part of a transmissive layer physically separated from and disposed above the first LED and the second LED.

6. The LED based illumination device of claim 3, wherein the first LED and the second LED each emit light with a peak emission wavelength within five nanometers of each other.

7. The LED based illumination device of claim 3, wherein more than fifty percent of light emitted from the first LED is directed to the first surface area, and wherein more than fifty percent of light emitted from the second LED is directed to the second surface area.

8. The LED based illumination device of claim 3, further comprising:

a third LED configured to receive a third current, wherein light emitted from the third LED enters the color conversion cavity and primarily illuminates a third wavelength converting material, the third wavelength converting material is physically separated from a light emitting surface of the third LED, wherein a light emitted from the LED based illumination device based on the light emitted from the third LED has a third color temperature that is different than the first color temperature and the second color temperature.

9. The LED based illumination device of claim 8, wherein the first, second, and third LEDs each emit light with a peak emission wavelength within five nanometers of each other.

10. The LED based illumination device of claim 8, wherein the first LED and the first wavelength converting material are configured to produce light that is emitted from the LED based illumination device with a color point below a Planckian locus in CIE 1931 color space, and wherein the third LED and the third wavelength converting material are configured to produce light that is emitted from the LED based illumination device with a color point above the Planckian locus in the CIE 1931 color space.

11. An LED based illumination device, comprising:

a color conversion cavity comprising a first surface area including a first wavelength converting material and a second surface area including a second wavelength converting material, the color conversion cavity comprising a first transmissive element having a first surface area including the first wavelength converting material and a second surface area including the second wavelength converting material, and a second transmissive element disposed above and separated from the first transmissive element, the second transmissive element includes a third wavelength converting material;

a first LED configured to receive a first current, wherein light emitted from the first LED enters the color conversion cavity and preferentially primarily illuminates the first wavelength converting material, the first wavelength converting material is physically separated from a light emitting surface of the first LED, wherein a light emitted from the LED based illumination device based on the light emitted from the first LED has a first color temperature;

a second LED configured to receive a second current, wherein light emitted from the second LED enters the color conversion cavity and preferentially primarily illuminates the second wavelength converting material, the second wavelength converting material is physically separated from a light emitting surface of the second LED, wherein a light emitted from the LED based illumination device based on light emission from the second LED has a second color temperature that is different than the first color temperature;

a third LED configured to receive a third current, wherein light emitted from the third LED enters the color conversion cavity and primarily illuminates the third wavelength converting material;

wherein the first current and the second current are selectable to achieve a range of correlated color temperature (CCT) of light output by the LED based illumination device.

12. The LED based illumination device of claim 11, wherein the first transmissive element is disposed above and separated from the first LED and the second LED.

13. The LED based illumination device of claim 11, wherein the first, second, and third LEDs each emit light with a peak emission wavelength within five nanometers of each other.

14. The LED based illumination device of claim 11, wherein a light emitted from the LED based illumination device based on the light emitted from the first LED has a color point below a Planckian locus in CIE 1931 color space, and wherein the light emitted from the LED based illumination device based on the light emitted from the third LED has a color point above the Planckian locus in the CIE 1931 color space.

* * * * *